US006352046B1

(12) United States Patent
Berg, Sr. et al.

(10) Patent No.: US 6,352,046 B1
(45) Date of Patent: Mar. 5, 2002

(54) TELESCOPING AND ROLLING COVER ASSEMBLY FOR A BARGE

(75) Inventors: Robin L. Berg, Sr., Hudson, WI (US); Brian Garcia, St. Paul; Kaushik Mallick, Savage, both of MN (US); Roderick Annis, Southaven, MS (US)

(73) Assignee: Proform Company, LLC, Minneapolis, MN (US)

( * ) Notice: Subject to any disclaimer, the term of this patent is extended or adjusted under 35 U.S.C. 154(b) by 0 days.

(21) Appl. No.: 09/492,188

(22) Filed: Jan. 27, 2000

(51) Int. Cl.[7] ..... B63B 19/12
(52) U.S. Cl. ..... 114/201 R
(58) Field of Search ..... 114/201 R, 201 A, 114/202

(56) References Cited

U.S. PATENT DOCUMENTS 3,618,551 A * 11/1971 Deslierres ..... 114/315
3,952,790 A * 4/1976 Leitch ..... 114/202
4,234,034 A * 11/1980 Leitch ..... 114/202
4,237,809 A * 12/1980 Hickman ..... 114/202
4,461,232 A * 7/1984 Berg ..... 114/201 R
5,170,717 A * 12/1992 Richmond et al. ..... 105/377
5,778,815 A * 7/1998 Shields ..... 114/201 R
6,016,761 A * 1/2000 Berg, Sr. ..... 114/201 R
6,138,597 A * 10/2000 Berg, Sr. ..... 114/201 R
6,161,493 A * 12/2000 Berg, Sr. ..... 114/201 R

* cited by examiner

*Primary Examiner*—Stephen Avila
(74) *Attorney, Agent, or Firm*—Piper Marbury Rudnick & Wolfe, LLP; Steven B. Kelber

(57) ABSTRACT

A telescoping and rolling cover assembly for a barge includes a plurality of cover sections that travel along a track or tracks provided on the barge coaming. The cover sections may be provided with anti-derailment clamps that engage a vertical lip of the barge coaming to prevent the covers from being pulled off the track. The clamps may further be provided with wind latch extensions that secure the cover sections when in a stacked position. The cover sections may be provided with a stacking shelf that provides a surface on which an overlying stacked cover may rest. The cover sections may travel along one or more tracks provided on the sides of the barge coaming. A portion of some cover sections may travel along tracks attached to underlying cover sections. The cover assembly may be made of fiber reinforced plastic.

21 Claims, 43 Drawing Sheets

TELESCOPING AND ROLLING COVER ASSEMBLY FOR A BARGE

BACKGROUND

1. Field of the Invention

The present invention relates to a telescoping and rolling (T&R) cover assembly for barges and the like.

2. Related Art

Barges are commonly used to transport a large variety of materials, such as grain, that must be protected from the natural elements. Over the years, a wide variety of covers have been designed to meet this need. Although some cover systems utilizing continuous covering material are known (see, for example, earlier U.S. Pat. No. 4,461,232), sets of adjacent cover sections are more commonly used. Such covers fall into one of two categories: lift-off and rolling. Lift-off covers, as their name implies, are lifted off and placed on barges usually using cranes located at a dock. The use of a crane for lift-off covers adds to the overall operating expense of these covers. Furthermore, because a crane is required, the covers cannot be opened prior to the barge arriving at a dock, resulting in still further expense for dock time. Finally, lift-off covers are subject to damage as a result of lifting the covers off barges, stacking the covers on the dock, and placing the covers back on barges.

Rolling covers are equipped with wheels or glides so that they travel along tracks. The rolling covers are generally designed such that at least some of the covers can be rolled or telescoped under others to expose at least a portion of a barge cargo hold. Covers such as these are known in the art as T&R covers.

An example of a steel T&R cover assembly is shown in U.S. Pat. No. 4,237,809, granted to Hickmann. There are several drawbacks associated with using steel barge covers, including corrosion and weight. For example, steel covers require a crane or outside power to open and close. FRP (fiber reinforced plastic) is a natural alternative; however, there are problems associated with using FRP for T&R covers. First, the lighter weight of FRP actually makes the covers more prone to being pulled off the track on which the wheels or glides travel. This problem is father exacerbated by use of the covers as tie points by barge and/or tug boat personnel. Damage to covers often results when covers are pulled off the track, besides making them inoperable. If a crane is required to place the covers back on track, the potential for further damage is increased.

A second issue with the use of FRP T&R covers concerns securing the covers when stacked on a dock (although the covers are telescoping, there will be situations in which they must be stacked on the coaming ends or removed entirely as discussed further below). Because of their light weight, T&R covers are more subject to being blown off a stack in strong winds, although steel covers may also be blown off by wind. Prior art FRP covers must therefore be tied down using extra equipment (rope, latches, etc.) when stacked; there are no provisions on the covers themselves for securing the covers. In strong winds, FRP covers may also be blown off the tracks or rails they ride on.

Referring now to T&R covers generally and specifically to U.S. Pat. No. 4,237,809, another problem associated with known T&R covers is the relative complexity of track mechanisms associated with these covers. For example, the '809 patent requires four separate tracks on the barge coaming for an embodiment in which four covers are "telescoped" into one.

What is needed is a simple, reliable, and lightweight telescoping and rolling barge cover.

SUMMARY

The present invention meets the aforementioned need to a great extent by providing a telescoping and rolling cover set manufactured using a lightweight material such as FRP. In preferred embodiments, the cover sections include anti-derailment clamps which provide a tie point, preferably in the form of a ring, while preventing the covers from being pulled off the track when the anti-derailment clamps are tied onto. The anti-derailment clamps can pivot when a substantially vertical force is applied to the tie point. Consequently, the clamps disengage the track and/or coaming when a crane ties onto the ring and lifts, thereby allowing the covers to be lifted off.

In preferred embodiments, the anti-derailment clamps include extensions which engage anti-derailment clamps attached to a cover section below when cover sections are stacked. In this way, they are prevented from being blown off the stack when exposed to high wind conditions.

In one embodiment of the invention, four covers may be telescoped into one along a single track on each side of a barge coaming. In a second embodiment of the present inventions, four covers may be telescoped into one along two tracks on each side of a barge coaming. In preferred embodiments of this type, both ends of at least one of the covers ride along a track on the barge coaming while at least one of the covers rides along a track on the barge coaming on one end while riding along a track attached to an underlying cover (as used herein, underlying cover refers to a cover onto which another cover may be at least partially telescoped) at an opposite end.

In yet another embodiment, two covers may be telescoped into one. In preferred embodiments of this type, two tracks are preferably provided such that both ends of each cover in a telescoping pair may travel along one of the two tracks at all times.

In preferred embodiments, the track is in the shape of an I beam and the cover sets include wheel assemblies with weight-bearing wheels that roll along the top of the track. A transverse guide wheel that rides along the top inside vertical surface of the I beam track to guide the cover along the track is also included in some preferred embodiments. In alternate preferred embodiments, the wheel and tracks are angled inwardly and may include a flange to keep the wheels on the track. In some embodiments, the track is simply the flanges of an H beam oriented such that the flanges are vertical.

Another aspect of the present invention is the provision of a stacking shelf. The stacking shelf is provided for those situations in which the covers must be removed from the rails and stacked onshore. The stacking shelf provides a weight bearing platform for stacked cover sections.

A method for fabricating FRP covers is also disclosed. In preferred embodiments, the center portions of cover sections are identical, while the height and width of the side portions (the part of the cover section nearest the coaming and tracks) of the covers are varied so that the resultant covers may telescope. Plugs including the common center sections and variable side sections are created for each cover section. Then, two mold halves are created from the plug such that the molds can produce the cover section with only a single seam. The method utilizes fewer molds than known methods, thereby reducing the number of seams to produce a better looking cover and reducing the amount of material required to fabricate the covers. The two mold halves are preferably sized such that they may be shipped by truck as a "wide load." Current regulations dictate that the maximum width for a wide load be 10 ft.

BRIEF DESCRIPTION OF THE DRAWINGS

A more complete appreciation of the invention and many of the attendant advantages and aspects thereof will be readily obtained as the same becomes better understood by reference to the following detailed description when considered in connection with the accompanying drawings, wherein.

DESCRIPTION OF THE PREFERRED EMBODIMENTS

Figure 1A:
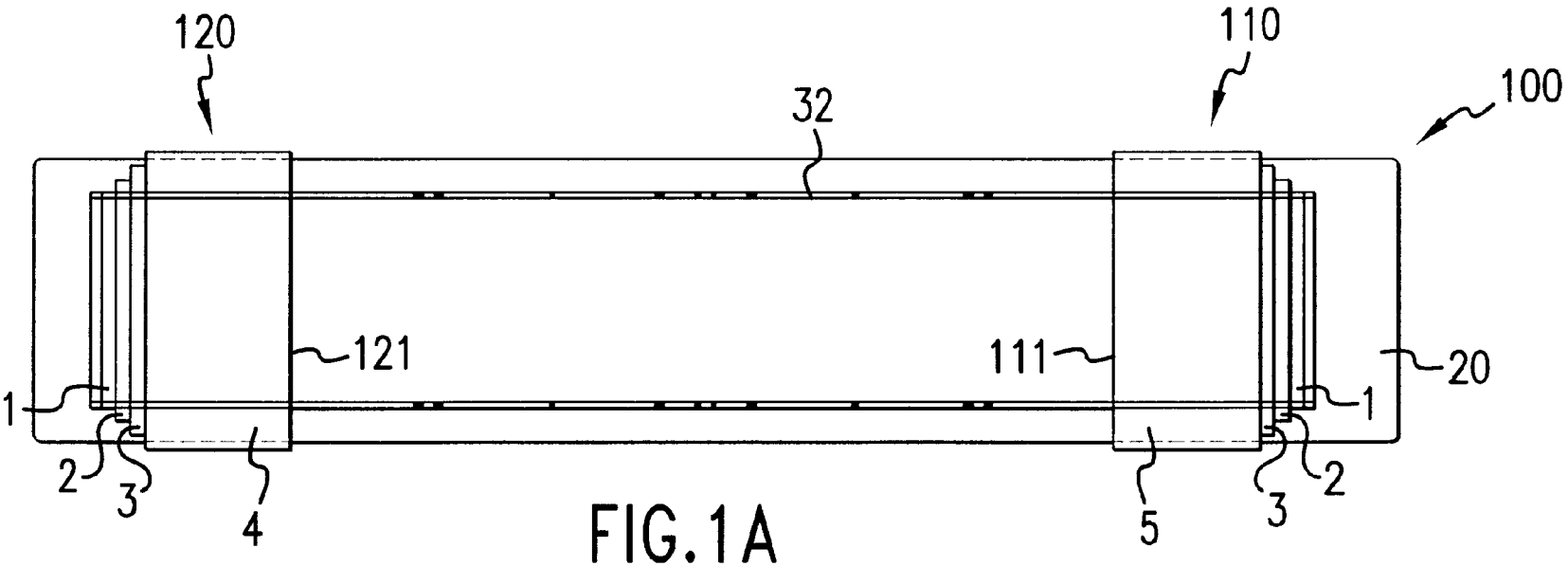
FIG. 1A is a top view of a barge cover assembly in an open position according to a preferred embodiment of the present inventions.

Referring now to the drawings, which are not drawn to scale and wherein like reference numerals designate identical or corresponding parts throughout the several views, FIG. 1A illustrates a top view of a telescoping and rolling barge cover assembly 100 in an open position over a cargo opening on a barge 20 according to a preferred embodiment of the present invention. The barge cover assembly 100 comprises two sets 110, 120 of covers. The cover sections 1–5 of sets 110 and 120 travel along tracks 32 on the top of the coaming 30. A cover set 100 fabricated with FRP may be opened and/or closed by one or two people. By comparison, operating a steel cover set of equivalent size and durability normally requires more people or power machinery.

Figure 1B:
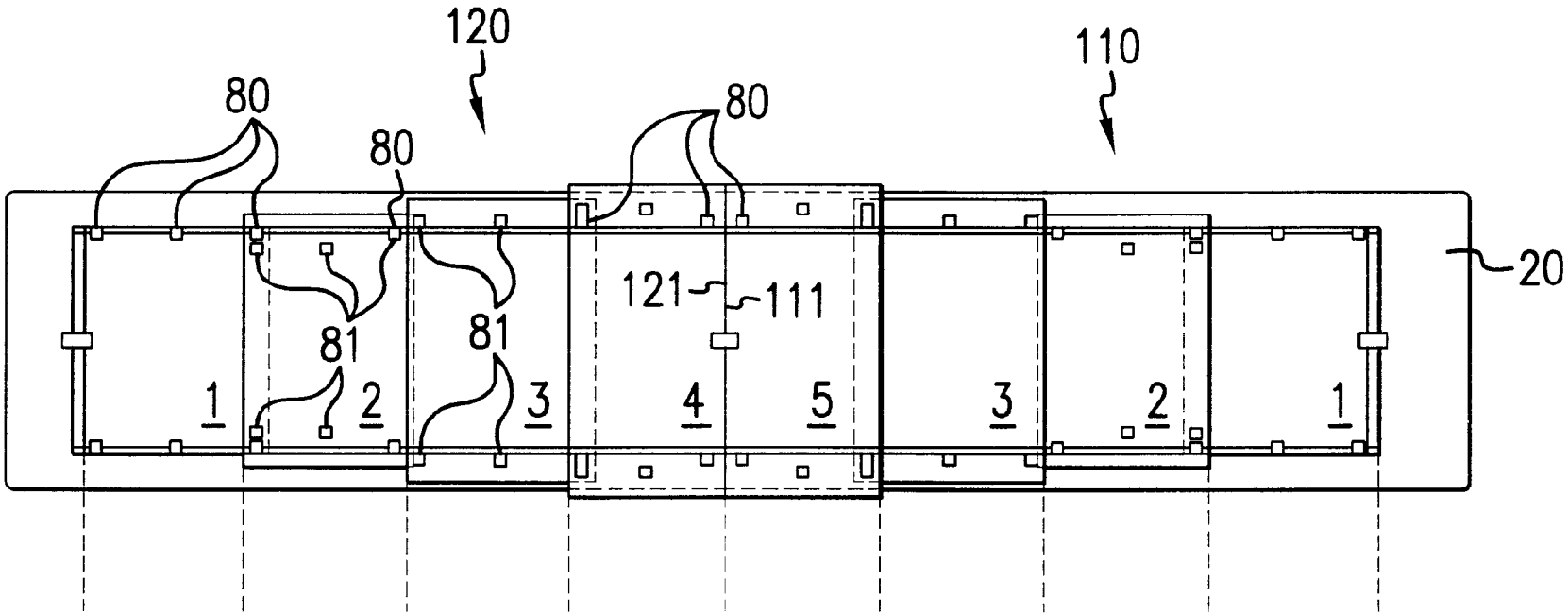
FIG. 1B is a top view of the barge cover assembly of FIG. 1A in a closed position.

Each set 110, 120 includes four covers which substantially (although not necessarily completely, as discussed further below) telescope into a single cover. A first set 110 is comprised of cover sections 1, 2, 3, and 4; while the second set is comprised of cover sections 1, 2, 3, and 5. The only difference between cover sections 4 and 5 is that they have mating weather seals at the edges 111, 121 where the sections 4, 5 meet at the center of the barge 20 when the cover assembly 100 is in the closed position, as shown in FIGS. 1A and 1B.

Figure 1C:
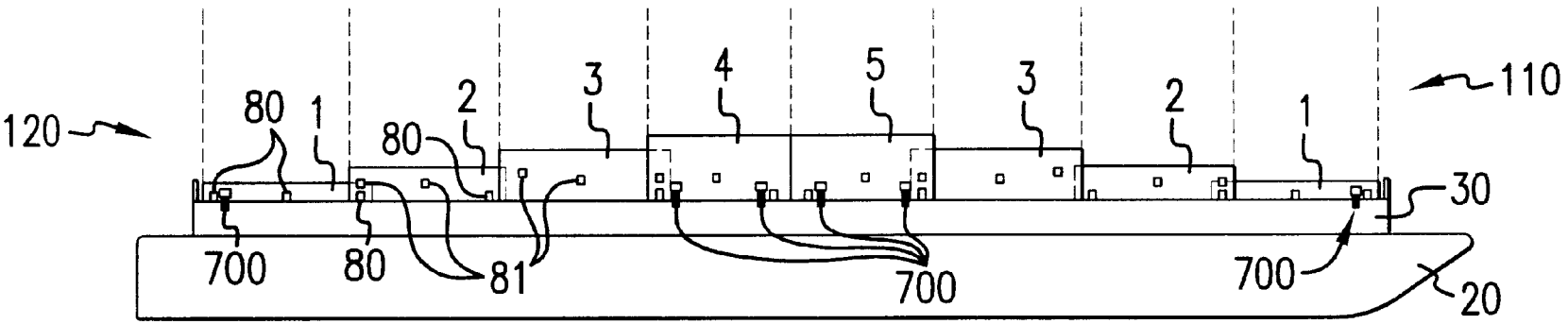
FIG. 1C is a side view of the barge cover assembly of FIG. 1B.

As discussed above, cover sections 1–5 remain partially overlapped in both the open and closed position. In this arrangement, the pair of wheels 80 or glides (one wheel or glide on each side) of a cover section closest to the center of the barge (also referred to herein as the front wheels) travel along a track or tracks attached to a coaming. The other pairs (although FIG. 1 shows a total of three pairs of wheels for each cover section, the number of pairs may be more or less) of wheels 81 or glides for all covers except the lowest cover on a track travel on a track attached to the top of the nearest underlying cover section. All of the wheels or glides for the lowest cover travel along the track or tracks on the coaming 30. Several variations of this scheme are illustrated below.

Figure 2:
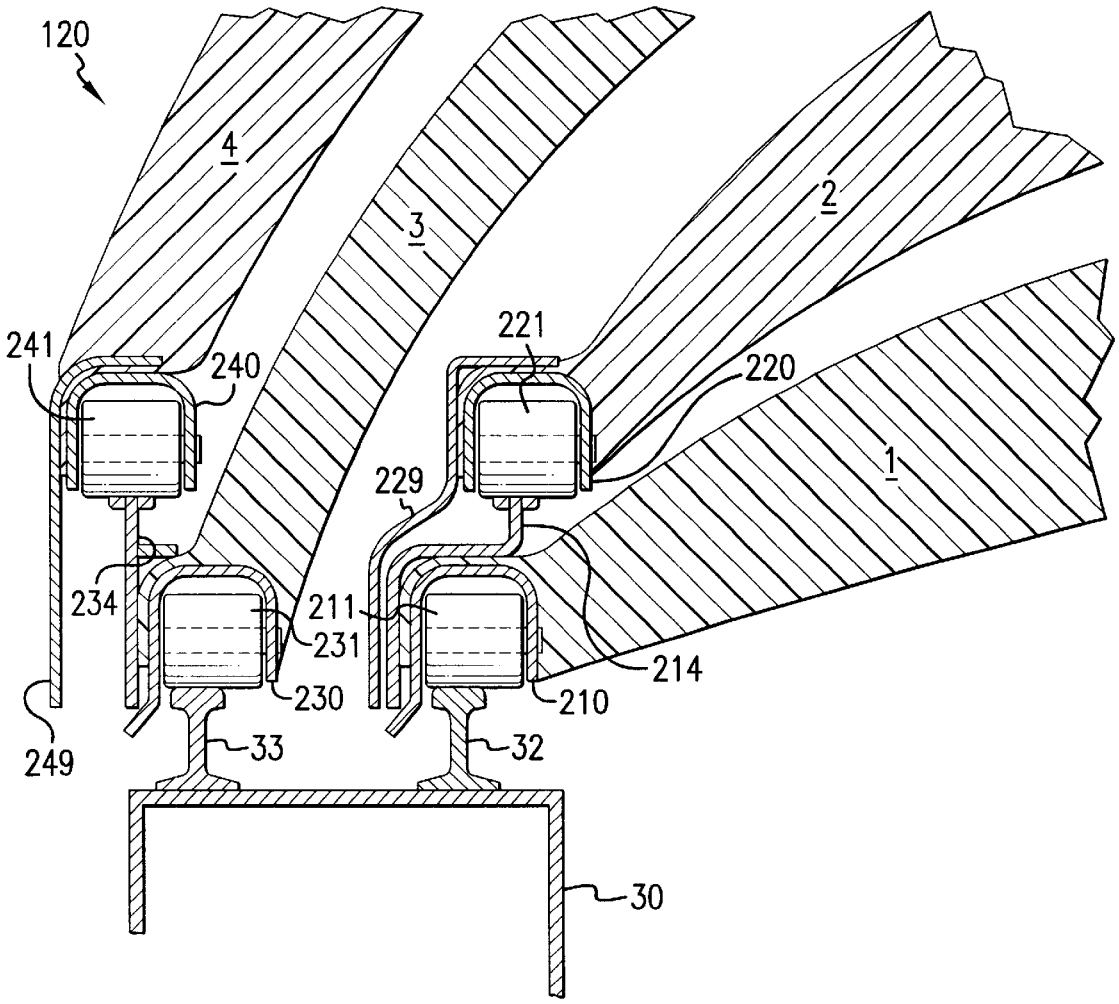
FIG. 2 is a cross sectional view of a portion of a barge cover set according to a preferred embodiment of the present inventions.

A preferred embodiment of the cover assembly 100 adapted to work with a dual track coaming will be discussed with reference to FIG. 2. FIG. 2 is a partial cross sectional view (taken along a cross section of each cover section 1–4 at a point corresponding to a wheel 211, 221, 231, 241) of a cover set 120. Each side of cover section 1–4 is attached to a wheel assembly 210, 220, 230, 240. The coaming 30 of FIG. 2 is provided with two tracks 32, 33 in the shape of an I beam. Cover sections 1 and 2 travel along the inside track 32, while cover sections 3 and 4 travel along the outside track 33.

The lowest cover section in the set 120 is cover section 1. All wheels 211 of cover section 1 ride along the track 32 as shown in FIG. 1. The front wheels (not shown in FIG. 2) of cover section 2 also ride along the inner track 32. However, the rear wheels 221 (all wheels other than front wheels; there may be one or more sets of rear wheels along various points of a cover section) travel along a track 214 attached to cover section 1. Similarly, all wheels (including wheels 231) of cover section 3 and the front wheels (not shown in FIG. 2) of cover section 4 travel along track 33, while the rear wheels 241 of cover section 4 travel along a track 234 attached to cover section 3. (It should be noted that the rear wheels 231 of cover section 3 are shown in a raised portion rather than a lowered position in content with the track 33 in FIG. 1). A guard member 229, 249 is attached to wheel assemblies 220, 240 on the upper cover sections 2 and 4, respectively. The guard members 229, 249 serve to keep the tracks 214, 234 from becoming fouled by debris and keep rain out when covers are closed.

Figure 3A:
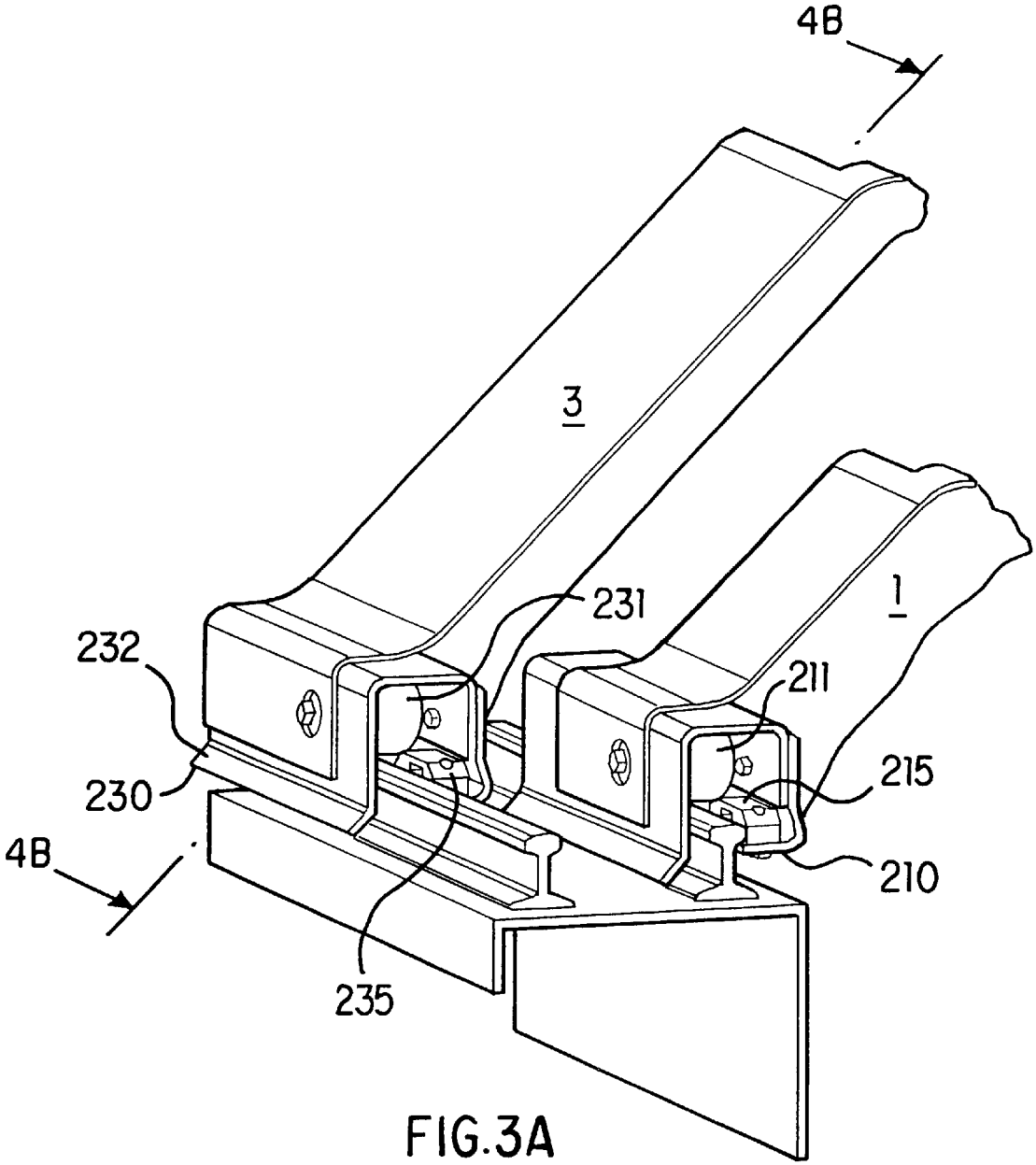
FIGS. 3A and 3B are perspective views of wheel assemblies cover included with sections of the barge cover set of FIG. 2.
Figure 3B:
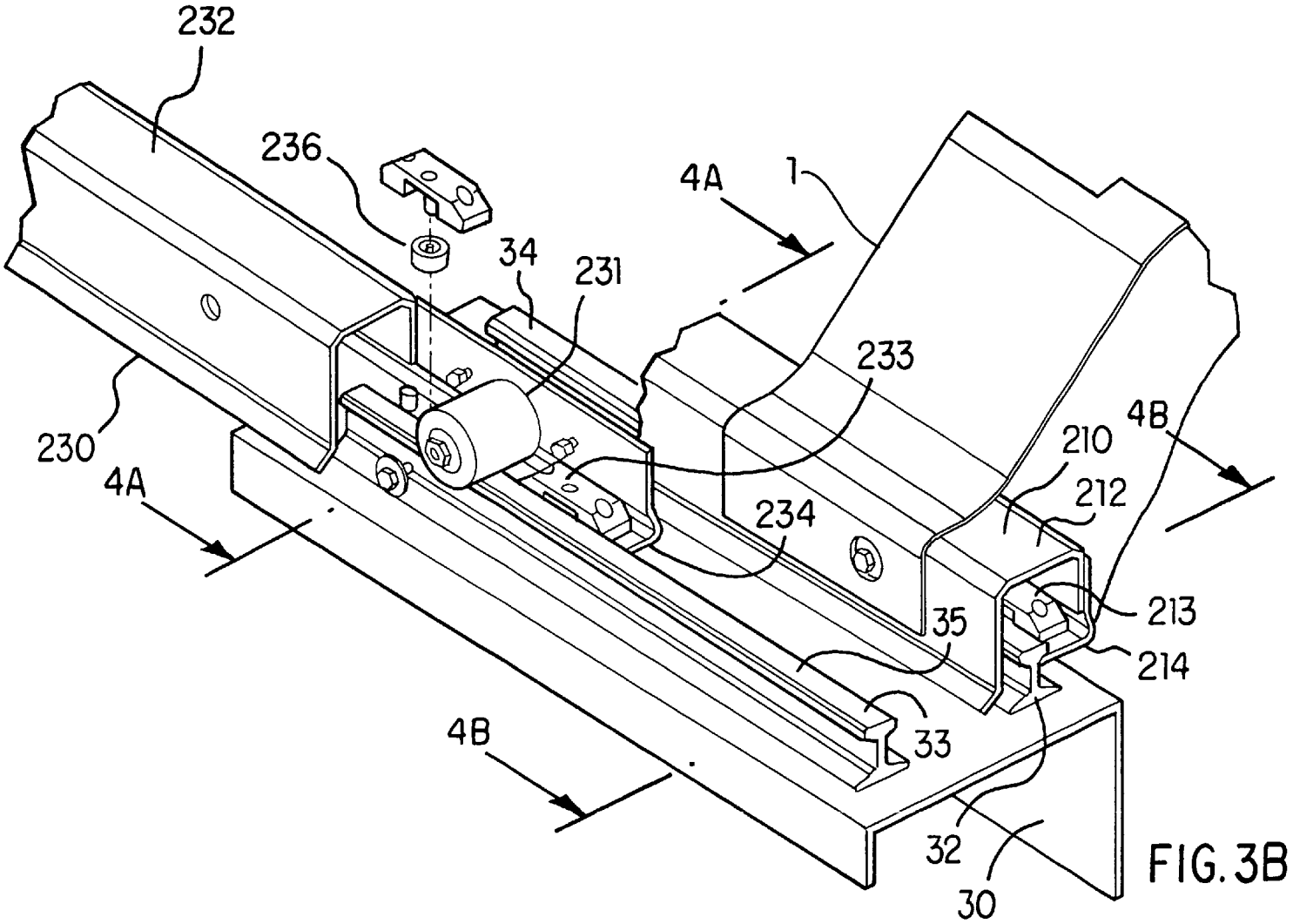

A more detailed perspective view of the wheel assemblies 210, 230 is shown in FIGS. 3A and 3B (the wheel assemblies 220,240 are similar). Each wheel assembly 210, 230 includes a weight bearing wheel 211, 231 attached to a channel 212, 232, which is turn attached to a cover section 1, 3. The channels 212, 232 preferably extend for substantially the length of the cover sections 1, 3 so that forces acting on the channels 212, 231 are distributed over the cover sections 1,3 to which the channels 212, 231 are attached. The wheels 211, 231 travel along the upper surface 34, 35 of the tracks 32, 33. Each wheel assembly 210, 230 also includes a guide roller assembly 215, 235. The wheels 211, 231 and guide roller assemblies 215, 235 of wheel assemblies 210, 230 (each assembly 210, 230 includes both a wheel 211, 231 and a guide roller assembly 215, 235) are more fully illustrated in the cross-sectional views of FIGS. 4A, 4B.

Figure 4B:
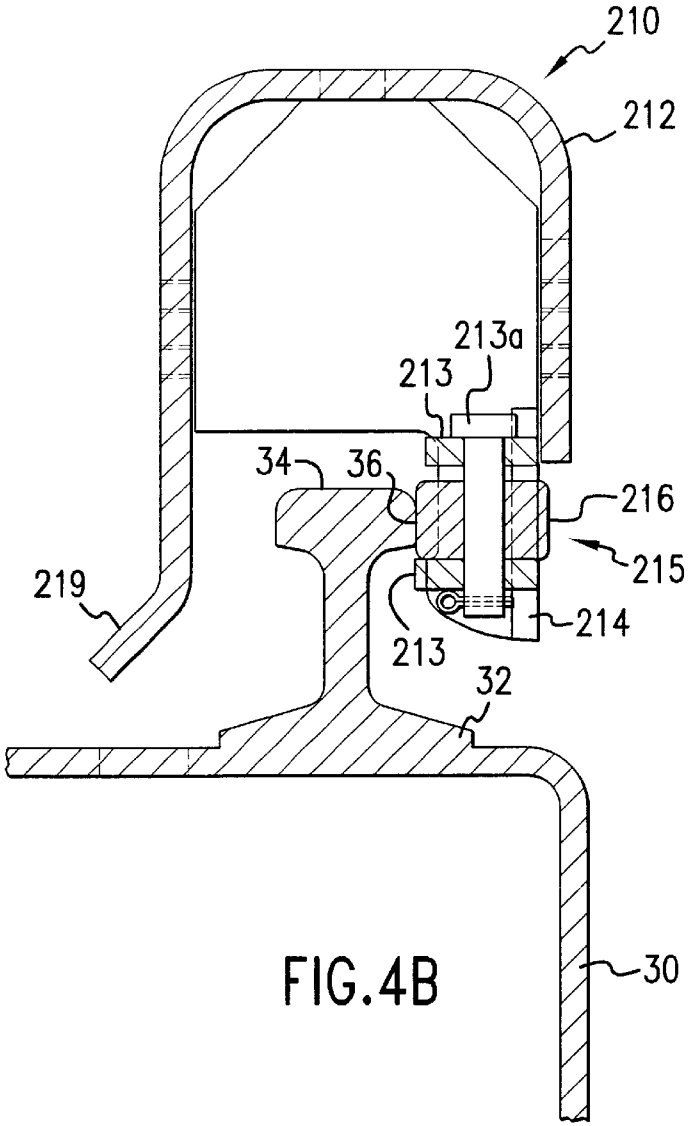
FIGS. 4A and 4B are cross sectional views of the wheel assemblies of FIGS. 3A and 3B.
Figure 4A:
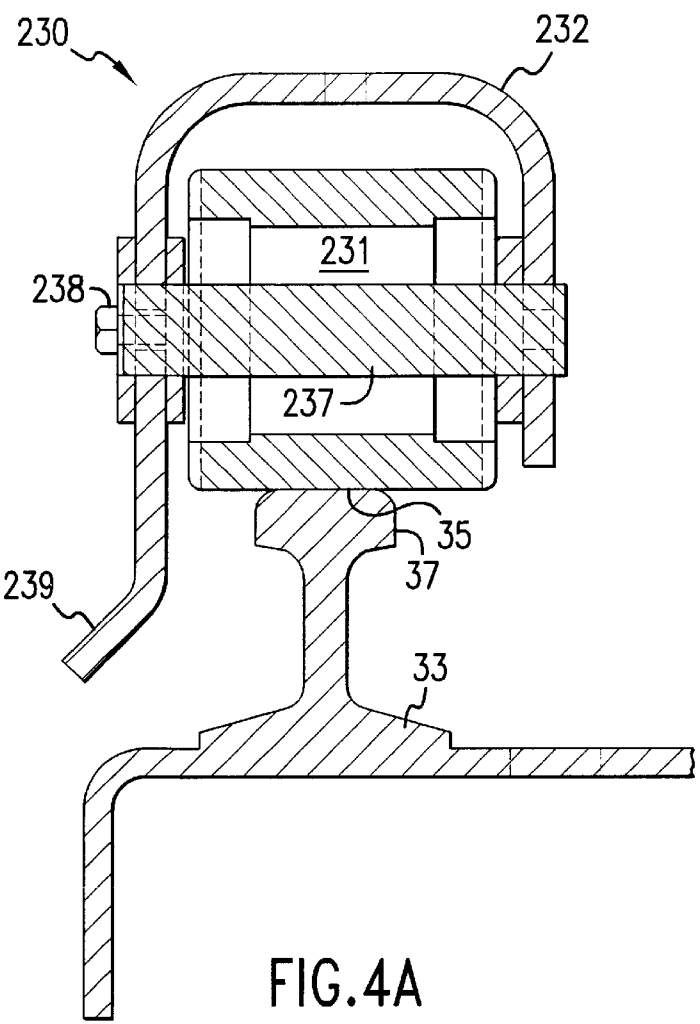

FIG. 4A is a cross sectional view of wheel assembly 230 taken along a line passing through the center of weight bearing wheel 231. The channel 232 includes an extension 239 that keeps debris of the track 33. The extension 219 on channel 212 performs the same function for wheel assembly 210 of FIG. 4B. (The extensions 219 and 239 are omitted in some preferred embodiments.) The wheel 231 turns on an axle 237 which is secured to the channel 232 by a shaft 238. FIG. 4B is a cross sectional view of wheel assembly 210 taken a long a line passing through the center of guide roller assembly 215. The guide roller assembly 215 is attached to the channel 212 by a bracket 214. Attached to the bracket 214 is a wheel mount 213. The guide wheel 216 is mounted on the wheel mount 213 and held in place by an axle 213*a*. The guide wheel 216 travels along the vertical surface 36 of track 32. Guide wheels 216, 236 are only required on the inside surfaces 36, 37 of the tracks 32, 33 because the weight of the cover sections 1, 3 will urge the wheel assemblies 210, 230 in an outward direction, thereby keeping the guide wheels 216, 236 in contact with the vertical surfaces 36, 37.

Figure 5:
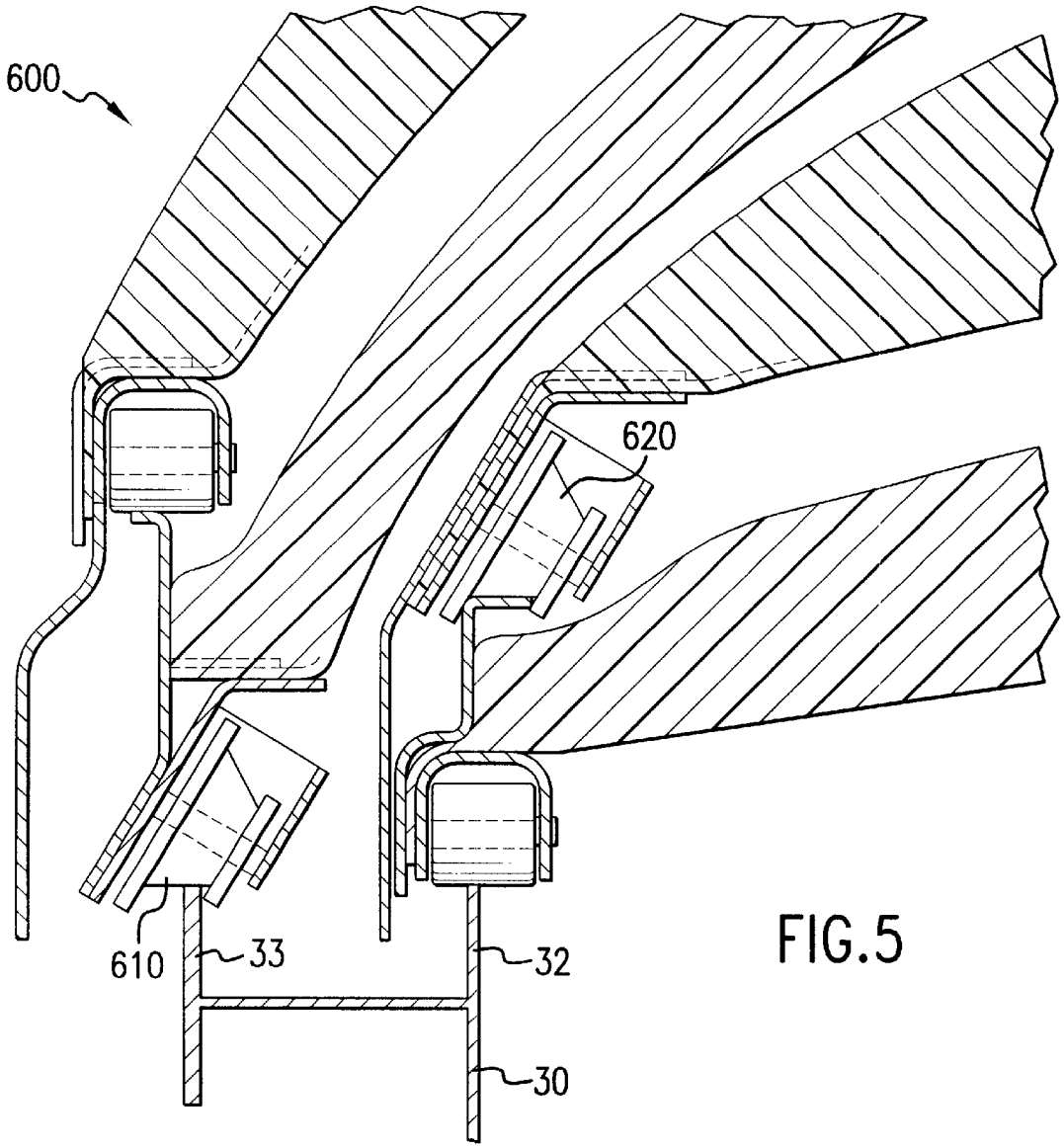
FIG. 5 is a cross sectional view of a portion of a barge cover assembly corresponding to the portion of FIG. 2 according to a second preferred embodiment of the present inventions.

FIG. 5 illustrates a view similar to FIG. 2 of an alternate embodiment of a two-track telescoping and rolling cover set 600. The major difference between cover set 600 and cover set 100 is the use of angled wheels 610, 620 in some locations.

Figure 6:
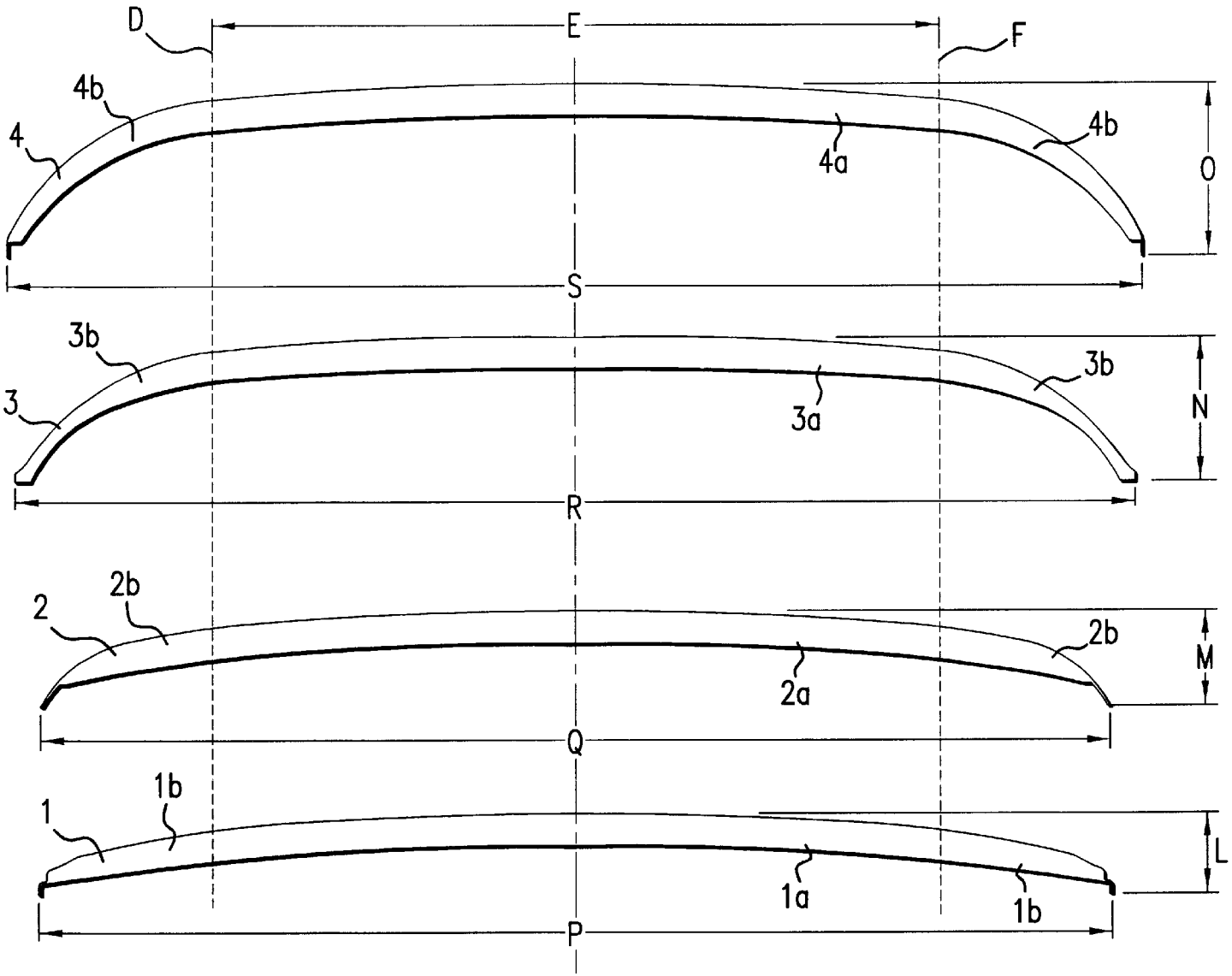
FIG. 6 is an end view of the cover set of FIG. 2.

FIG. 6 is an end view of cover sections 1–4, excluding wheel assemblies 210–240.

Cover sections 1–4 have increasing heights L–O and widths P–S; however the center sections 1*a*–4*a* of each cover section 1–4 are identical. As discussed further below, this allows the cover sections 1–4 to be fabricated by using common molds for the center portions 1*a*–4*a* and simply changing the mold for the respective end portions 1*b*–4*b*.

Figure 7:
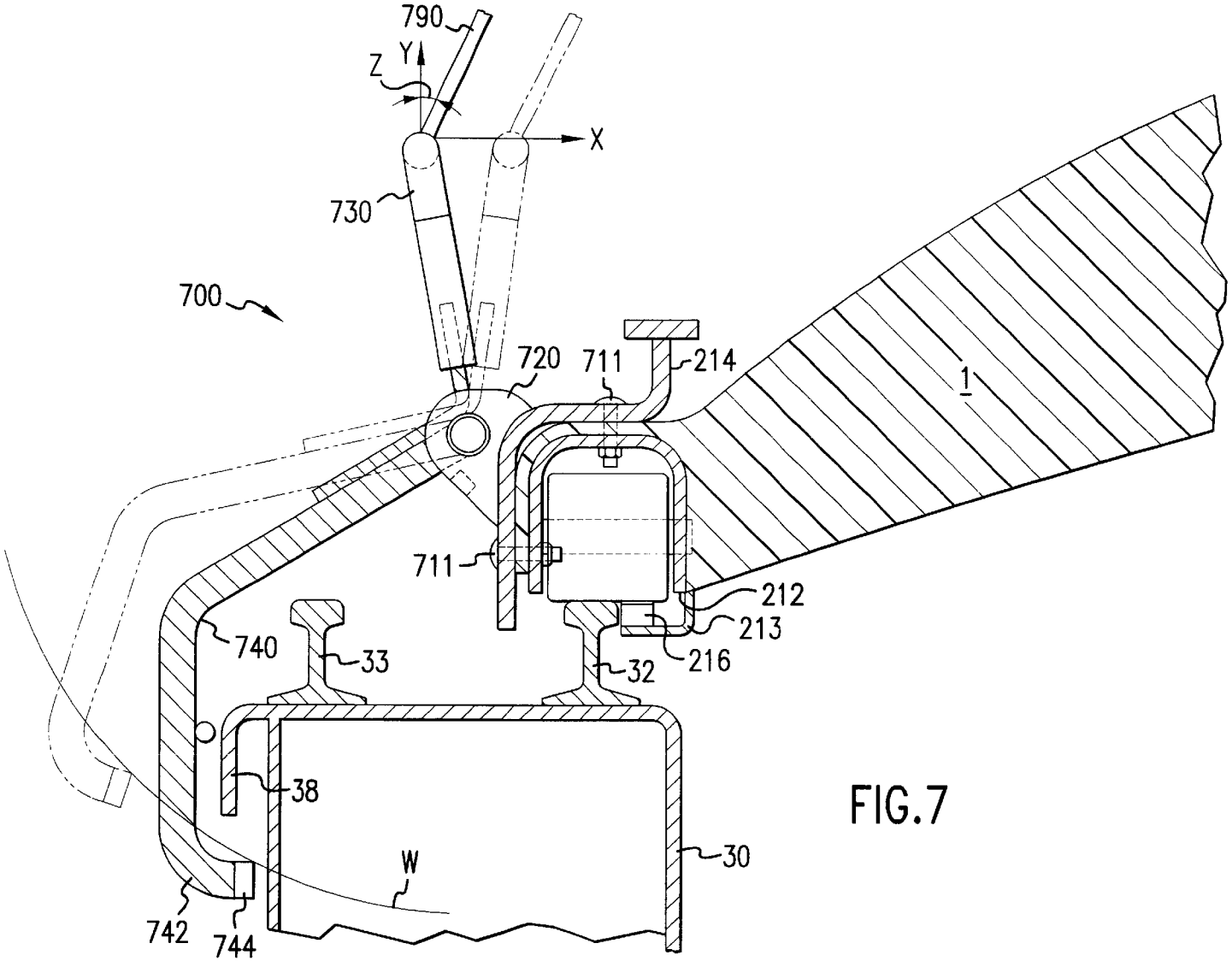
FIG. 7 is a cross sectional view of an anti-derailment clamp mounted to a cover section according to a third embodiment of the present invention.

Referring back now to FIG. 2, it can be seen that the wheel assemblies 210–240 do not prevent the cover from being lifted off the tracks 32, 33. Preferred embodiments of the present invention include an anti-derailment clamp 700 as shown in FIG. 7 to prevent a cover section from being unintentionally lifted off or pulled off the respective track 32. FIG. 7 is a cross sectional view of an anti-derailment clamp 700 attached to cover section 1 (load bearing wheel 211 and guide assembly 215 are not shown in FIG. 7 for the sake of simplicity). The anti-derailment clamp 700 is attached to an end of cover section 1 closest to the end of the barge 20. No derailment clamp is necessary at the ends of cover section 1 closest to the center of the barge because cover section 2 is always at least partially covering and exerting a downward force on those ends.

Figure 8:
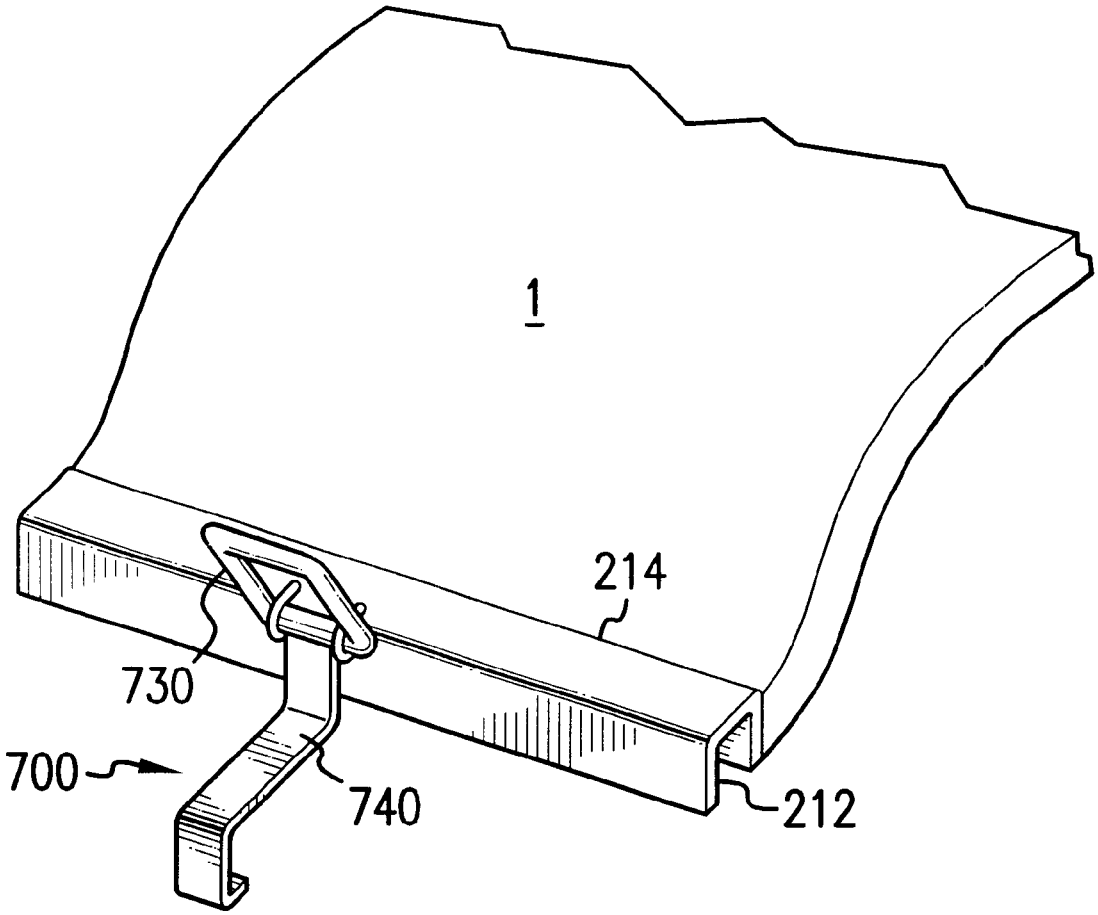
FIG. 8 is a perspective view of a clamp similar to the clamp of FIG. 7 according to an embodiment of the invention.

The clamp 700 includes a tongue 720 which is preferably welded to the upper track 214. The upper track 214 and channel 212 are attached to the cover section 1 by fasteners 711 and 712. A ring 730 is pivotally mounted near the end of the tongue 720. Attached to the ring 730 is an engaging bar 740 which includes a curved end section 742. A perspective view of a similar clamp 700 attached to the track 214 of cover section 1 is shown in FIG. 8.

Referring back now to FIG. 7, it can be seen that the curved end section 742 curves under the vertical lip 38 of the coaming 30 to prevent the cover section 1 from being lifted off when the clamp 700 is in the normal position, shown in solid lines in FIG. 7. The weight of engaging bar 740 will keep the engaging bar 740 in the normal position under most conditions. A spring (not shown in FIG. 7) may be added to urge the engaging bar 740 into the normal position for additional security. There are occasions on which it is desirable to remove the cover section 1 from the track 32. On such occasions, a cable 790 may be attached to the ring 730 at one end and to a lifting device such as a crane (not shown in FIG. 7) at the other end. In this situation, cable 790 will be inclined at an angle Z with respect to the vertical axis Y (because similar cables will be attached to all four corners of the cover section 1). As the crane begins to lift, the cable exerts a force on the ring 730 along both the X and Y axes. The force applied by the cable 790 along the X axis will cause the ring 730 and the engaging bar 740 attached thereto to pivot, thereby moving the engaging bar 740 into a position such that it is out of engagement with the coaming 30 as shown in phantom in FIG. 7.

The curved end section 742 may include an optional upward lip (not shown in FIG. 7). The upward lip must be short enough such that it can clear the vertical lip 38 of the coaming 30 when the engaging bar is swung out along arc W. The upward lip is not necessary and is excluded in some preferred embodiments.

Figure 9A:
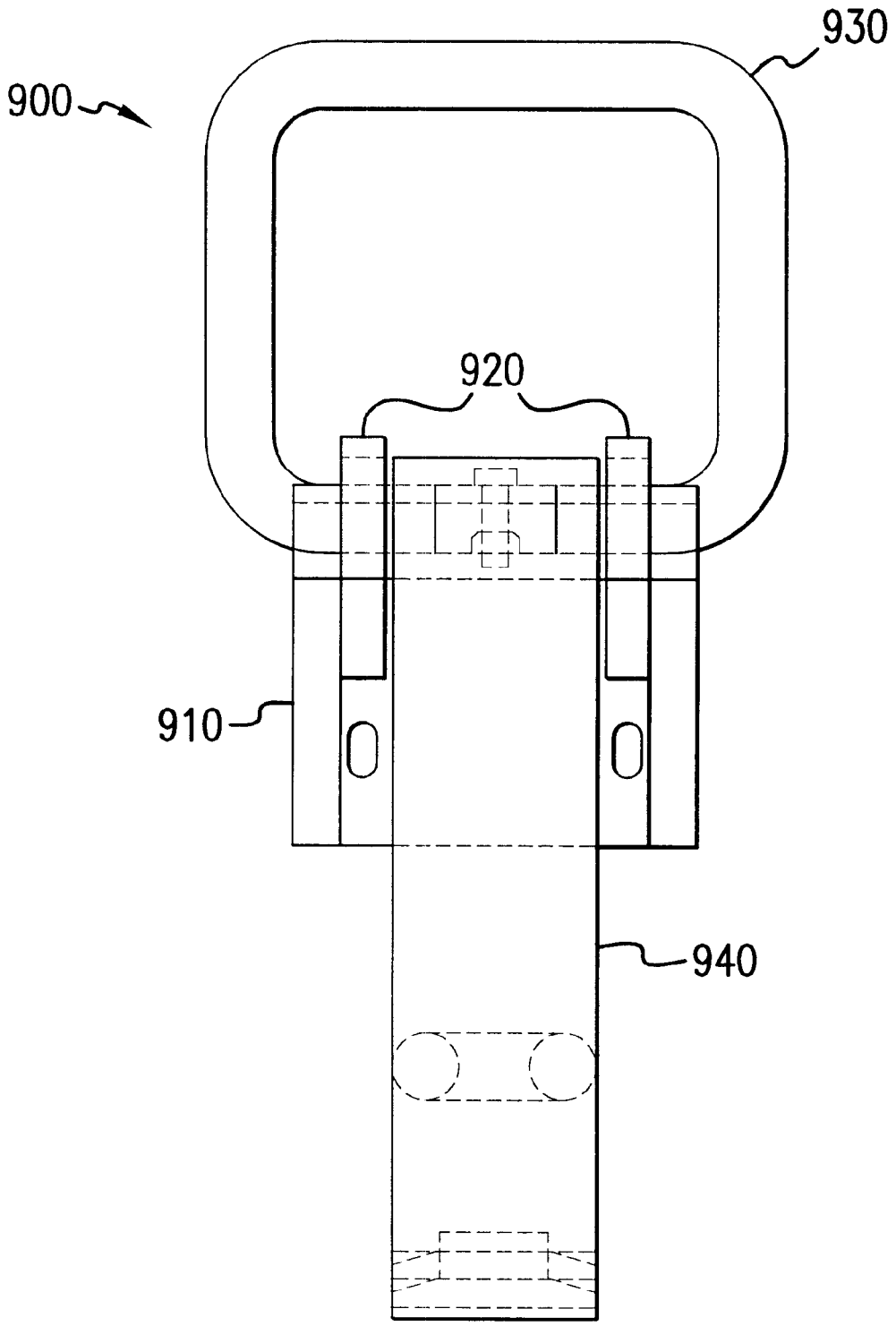
FIGS. 9A, 9B, and 9C are front, side and perspective views, respectively, of an anti-derailment clamp according to an embodiment the present invention.
Figure 9B:
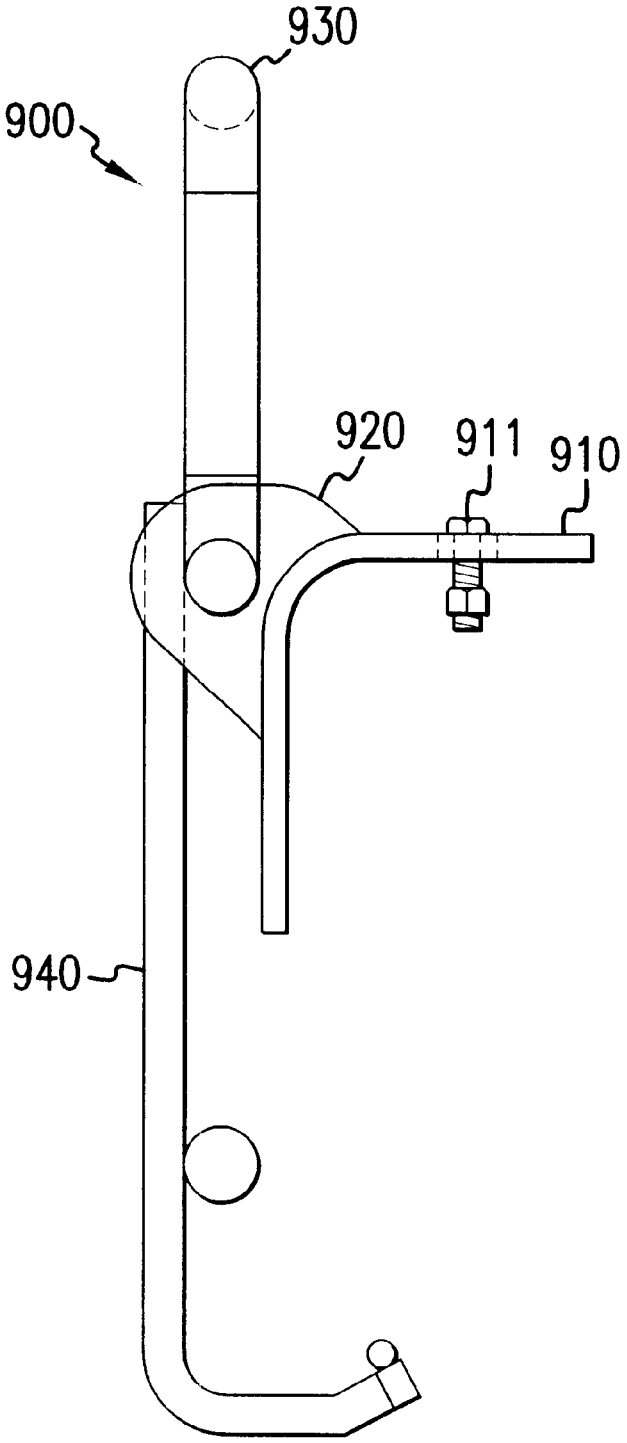
Figure 9C:
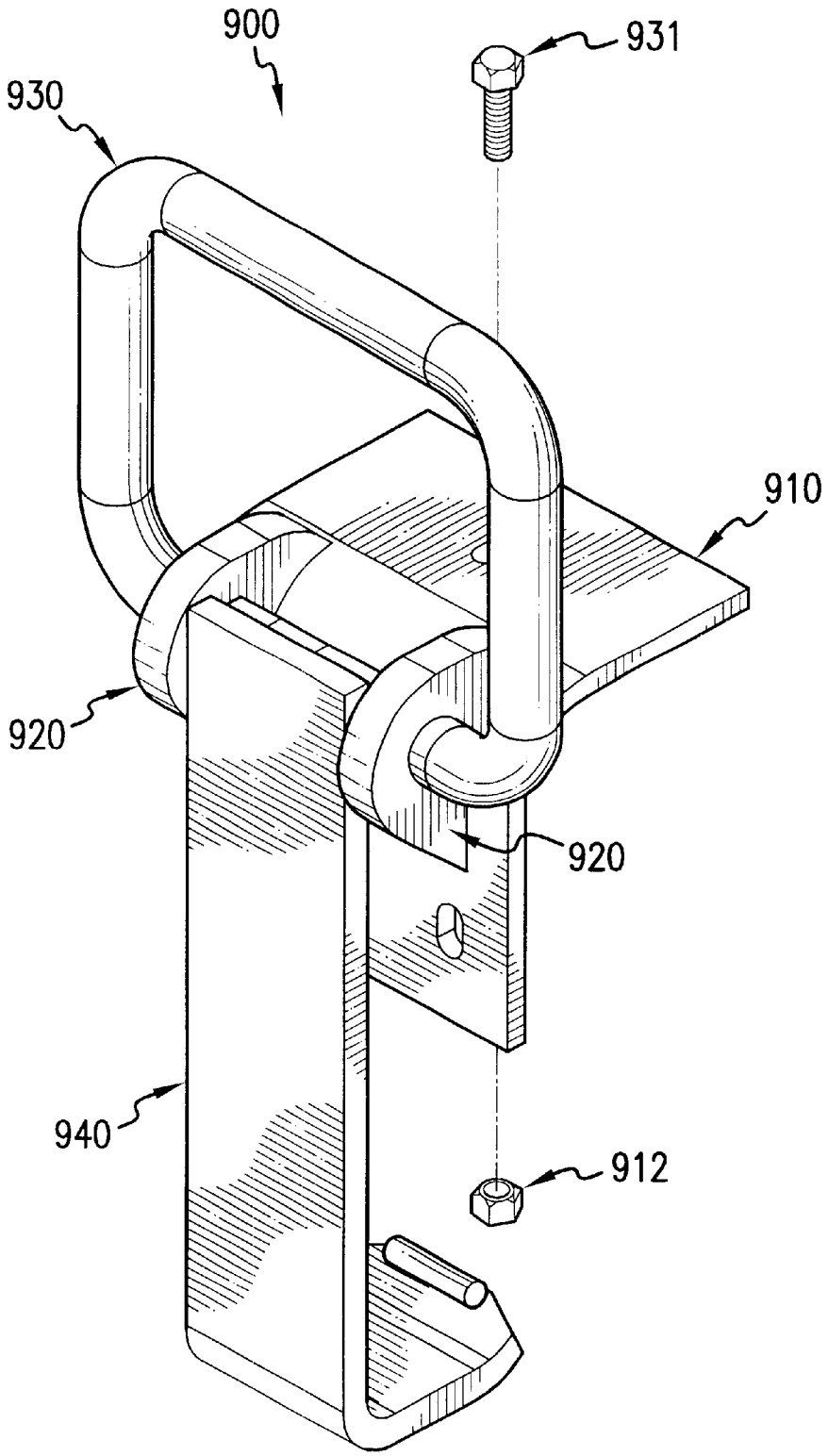

As discussed above, the clamp 700 is designed for cover section 1 which travels along inside track 32. Rear, side, and perspective views of a similar clamp 900 that travels on the outside track 33 and is used at the center-most ends of cover section 4 are shown in FIGS. 9A, B, C, respectively. The clamp 900 is similar to the clamp 700 with the following exceptions: 1) the tongue 920 is shorter than the tongue 720 because of the absence of an outside track (such as the track 212 on cover section 1) on cover section 4; and 2) the engaging bar 940 is straight because cover section 4 rides along outside track 33 rather than inside track 32.

A persistent problem encountered with the use of known T & R covers is the tendency of the covers to be pulled off track when barge or dock personnel tie onto the covers. Although the barges are equipped with cleats, human nature being what it is, barge and/or dock personnel will often tie onto covers for the sake of convenience. When this occurs, the side of the cover which is tied onto may itself be pulled upward and off the track, or may apply a torque, or moment, on the entire cover section, resulting in the opposite side being pulled of the rails. Furthermore, when personnel tie onto a point attached to FRP, damage to the FRP can result.

Figure 10:
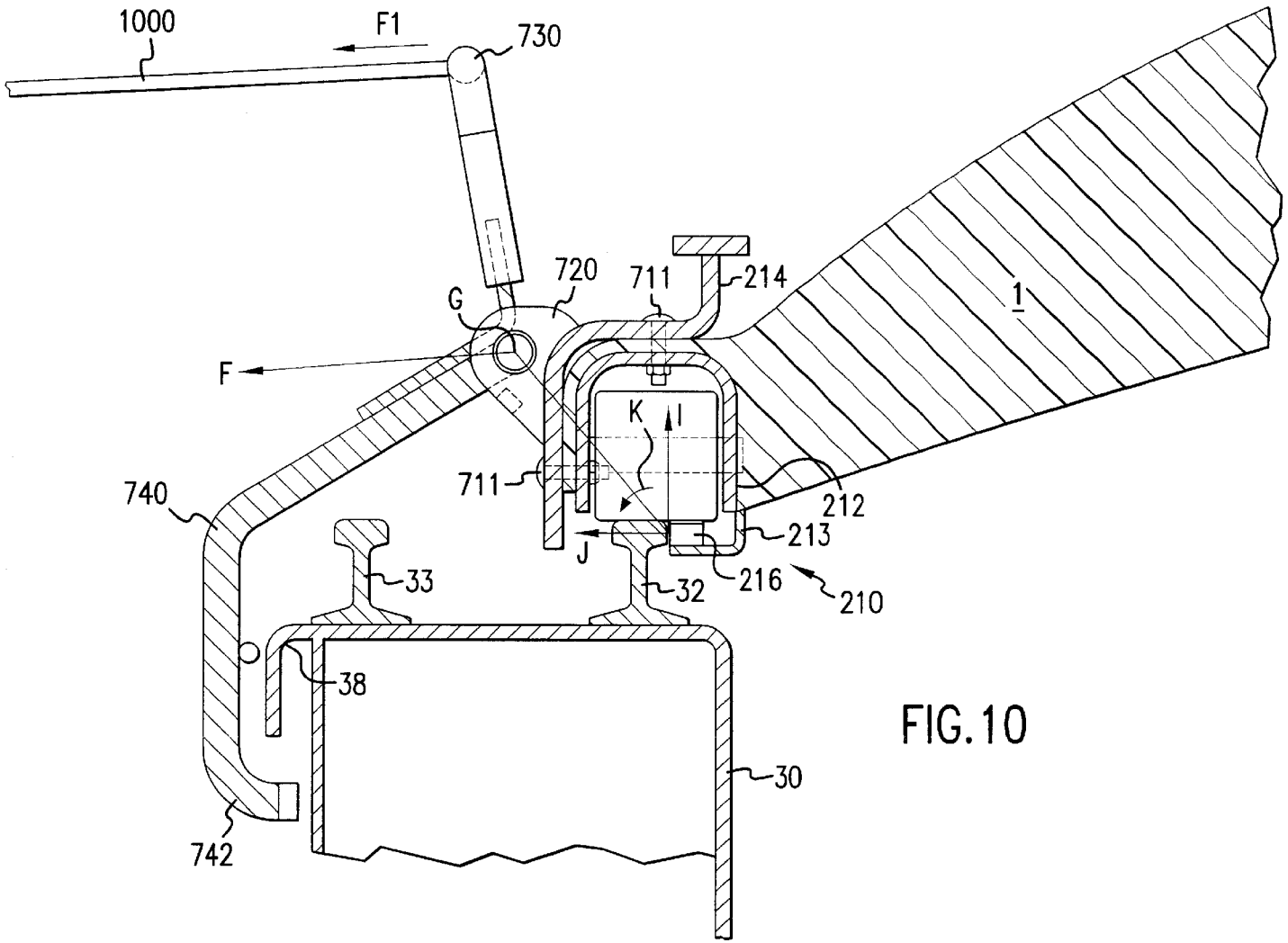
FIG. 10 is cross-sectional view like FIG. 7 showing the clamp used as a tie point.

These problems are solved in large point by the anti-derailment clamps of the present invention. Referring now to FIG. 10, a cable 1000 is shown tied onto ring 730. The cable is oriented in a direction consistent with being tied to a dock (not shown in FIG. 10). The cable 1000 exerts a force F1 on the ring 730. Because the ring 730 is fixedly attached to engaging bar 740 and engaging bar 740 is prevented from moving by the vertical coaming lip 38, a net force F is applied at point G. This force is translated through tongue 720, track 214, fastener 711, channel 212, mount 213 and wheel 216 to a force along axis J acting on the vertical surface 36 of track 32. Note that in this arrangement no force is applied to the fiberglass cover section 1; rather, all force is transmitted from the ring 730 to the track 32 through channel 212 and other components of the wheel assembly 210. Note also that a moment K also acts about the point at the intersection of axes I and J. The moment K is transmitted through the wheel 211 to the upper surface 34 of the track 32. Again, the FRP is not subject to potentially damaging forces. If the cable 1000 is at a positive angle with respect to the horizon, then the upward component of the force F is opposed by a downward force applied by the engaging bar 740. Because of the protection to the FRP cover section 1 provided by this arrangement, the rings 740 are painted yellow in preferred embodiments to make the rings 740 attractive to barge and/or dock personnel looking for a tie point and disinclined to use cleats provided on the barge 20.

Figure 11A:
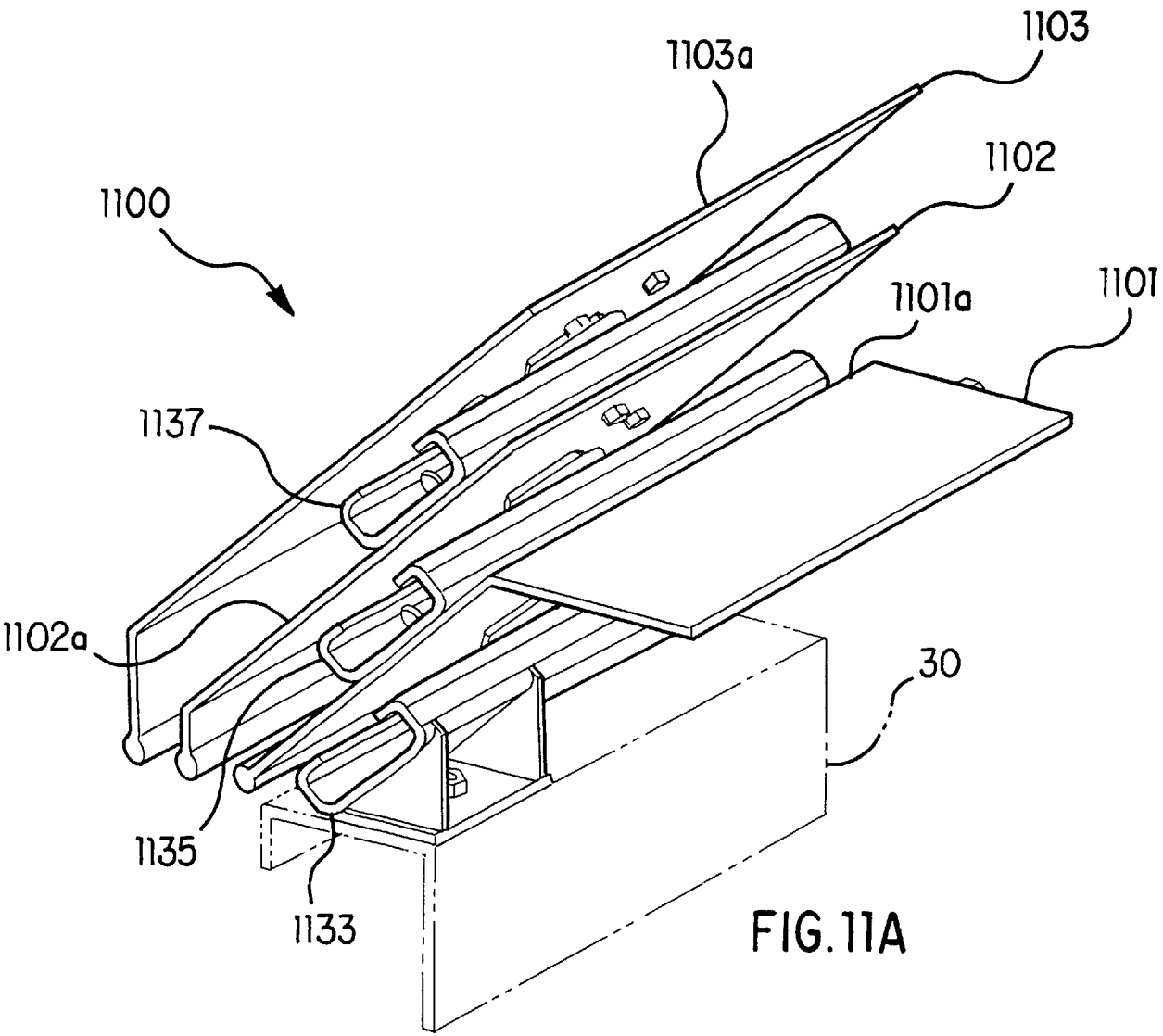
FIGS. 11A, 11B and 11C are perspective, exploded, and side views, respectively, of a cover set according to a fifth preferred embodiment of the present invention.
Figure 11B:
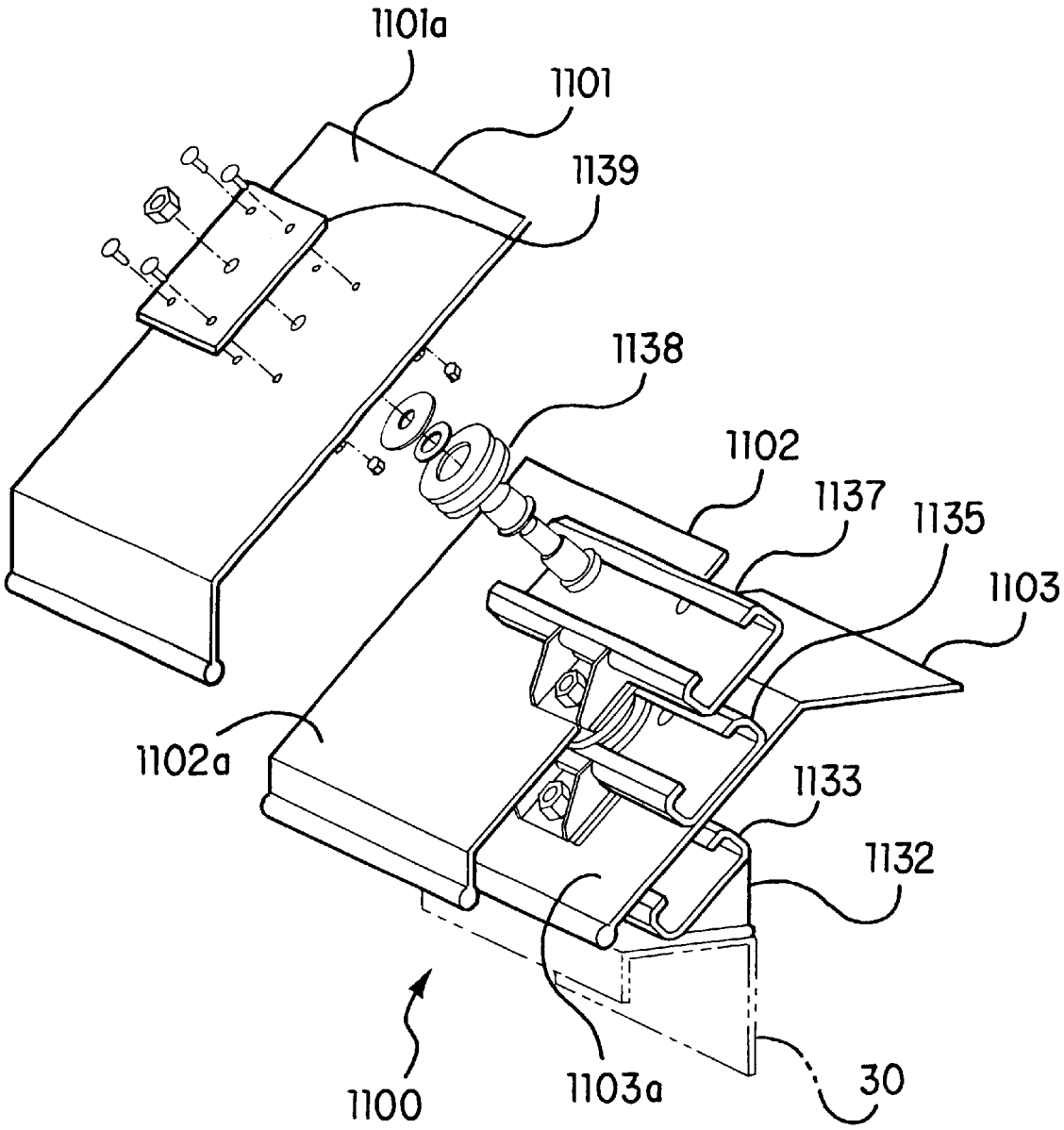
Figure 11C:
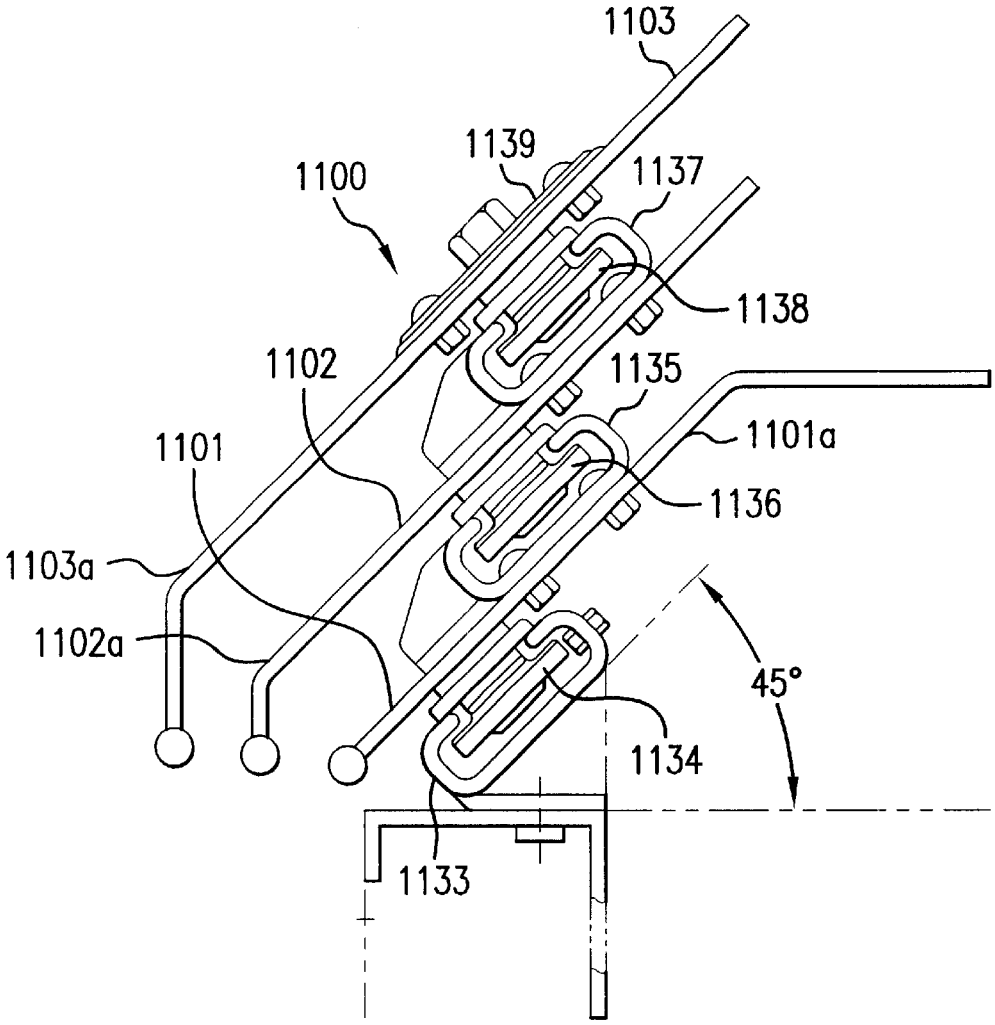

The embodiments of cover sets discussed above operate on two tracks provided on the barge coaming. FIGS. 11A–C show a side view of a portion of a cover set 1100 similar to the portion of FIG. 2. Cover set 1100 includes three covers sections 1101–1103, but can easily be extended to include a fourth section similar to the embodiments discussed above. A single track 1132 is attached to the coaming 30. A C channel 1133 is attached to the track 1132 at an angle. A wheel 1134 attached to the underside of a correspondingly-angled section 1101*a* of cover section 1101 travels along and is held captive by the C channel 1133. A second C channel 1135 is attached to the top side of cover section portion 1101*a*. A second wheel 1134, which is attached to the underside of an angled portion 1102*a* of cover section 1102. Cover section 2 also has a C channel 1137 attached to its top side, along which wheel 1138 travels and is held captive. The wheel 1138 is attached through cover section 1103 (again at an angled portion 1103*a*) to mounting plate 1139. This concept could easily be modified to make use of angled wheels on straight track such as those shown in FIG. 5.

All of the foregoing embodiments involve telescoping at least three cover sections into a length approximately equal to a single cover section (the lengths are only approximately equal because each cover sections extends past underlying cover sections by an amount sufficient to allow the wheel assemblies to be mounted as shown in FIG. 1). However, three-in-one or four-in-one (or more) telescoping ability is not always required. For many applications, a two-in-one telescoping ability is more than sufficient. Such a cover assembly 1200 is shown in FIG. 12.

Figure 12A:
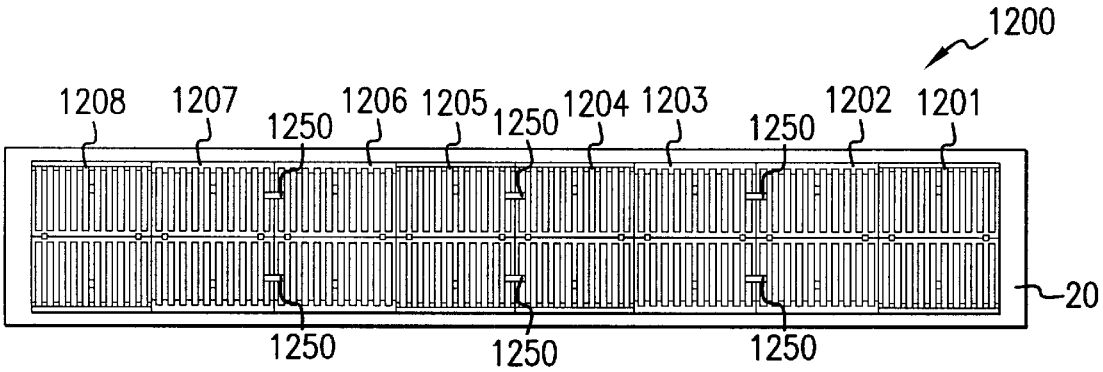
FIGS. 12A, 12B and 12C are top, side and perspective views, respectively, of a barge cover assembly according to a sixth preferred embodiment of the present invention.
Figure 12B:
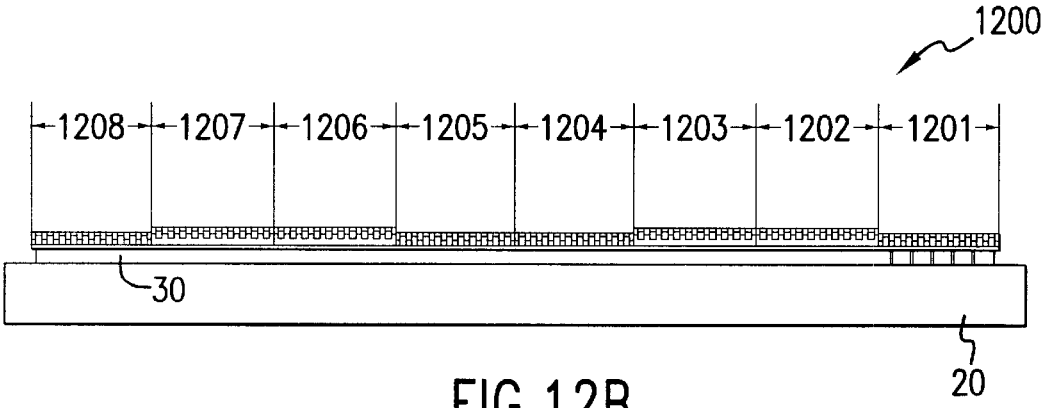
Figure 12C:
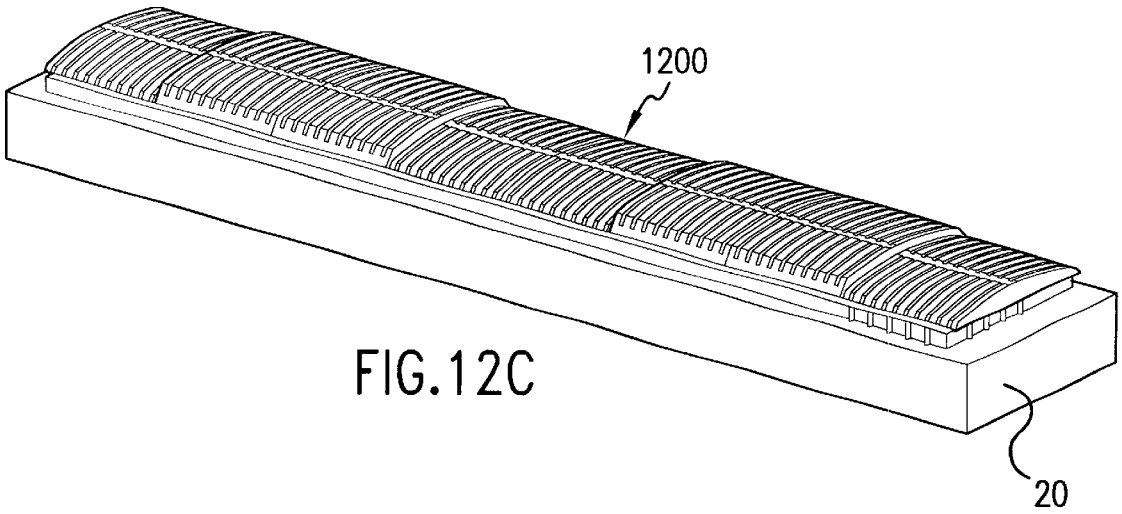
Figure 13:
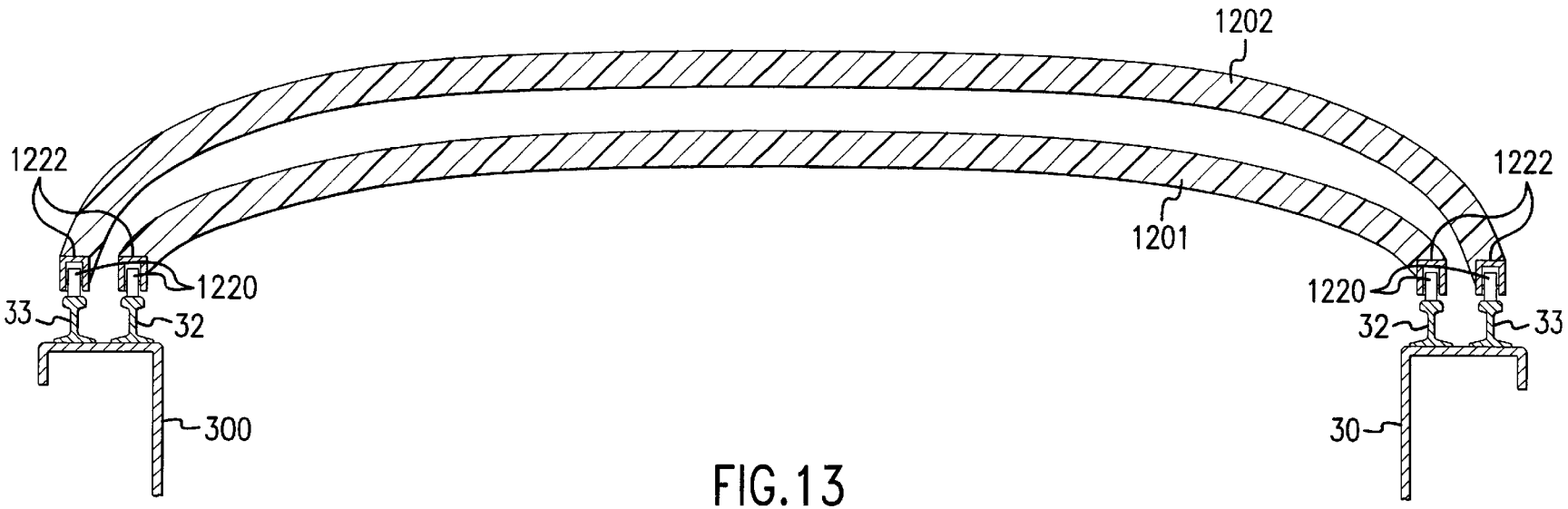
FIG. 13 is an end view of two cover sections that form part of the cover assembly of FIG. 12.

FIGS. 12A–12C show a top, side, and perspective views, respectively, of an eight cover section 1201–1208 barge cover assembly 1200. As can be seen most readily in FIG. 12B, each of the cover sections is one of two heights, high or low. Cover sections 1201, 1204, 1205 and 1208 are low, while cover sections 1202, 1203, 1206, and 1207 are high. Thus, the order of the cover sections is low, high, high, low, low, high, high, low as shown in FIG. 12. Referring now to FIG. 13, which is an end view of cover sections 1201 and 1202, it can be seen that the low section 1202 may be telescoped into (rolled under) the high section 1201. This is accomplished by providing an outside track 33 on the coaming 30 for the high cover section 1202 to travel along and providing a separate inside track 32 for the low cover section 1201 to travel along. The channels 1222 (which extend for the length of each of the cover sections 1201–1208 as discussed in previous embodiments) and wheel assemblies 1220 may be substantially the same as the lower wheels 211,231 of FIGS. 3 and 4. The rails may also be an "H" section coaming.

Figure 14A:
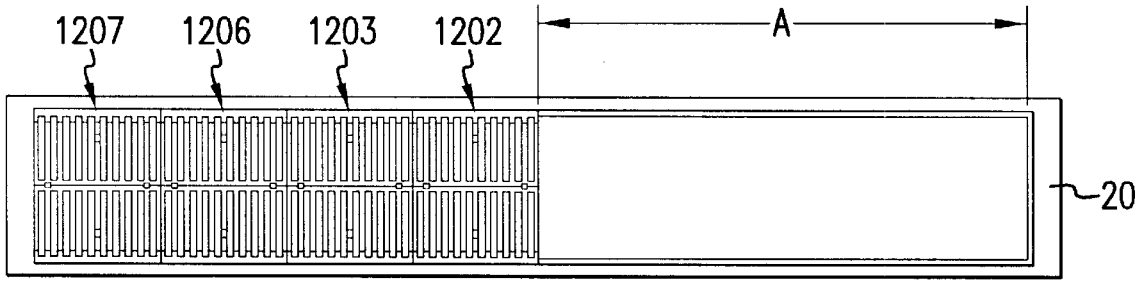
FIGS. 14A–G are views of the cover assembly of FIG. 12 in various configurations.
Figure 14B:
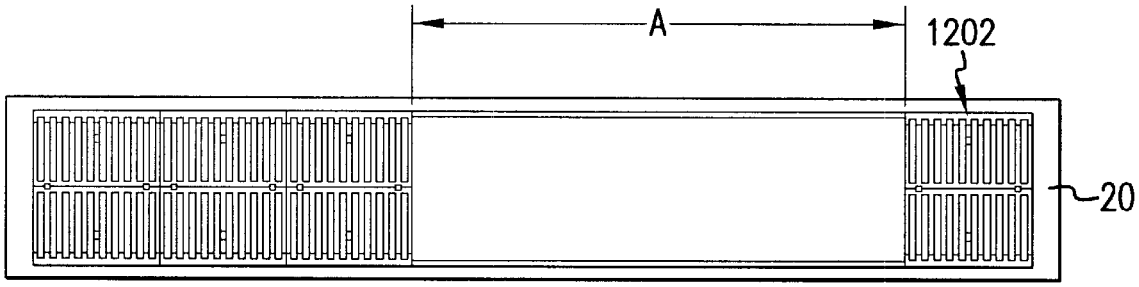
Figure 14C:
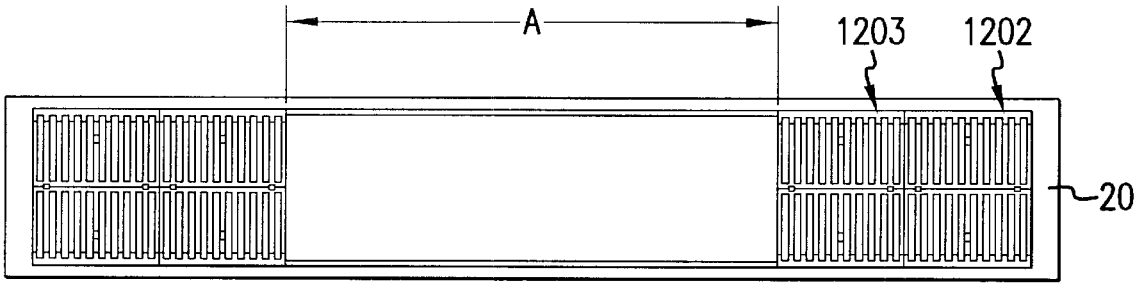
Figure 14D:
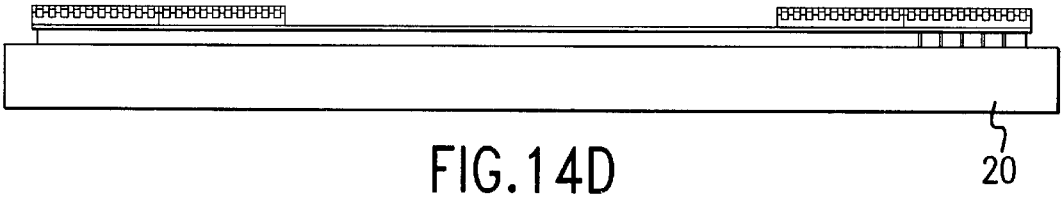
Figure 14E:
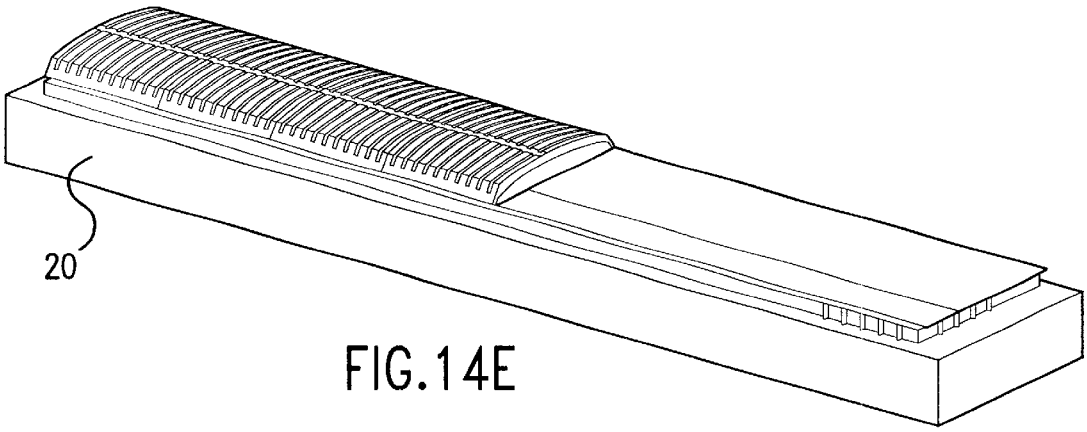
Figure 14F:
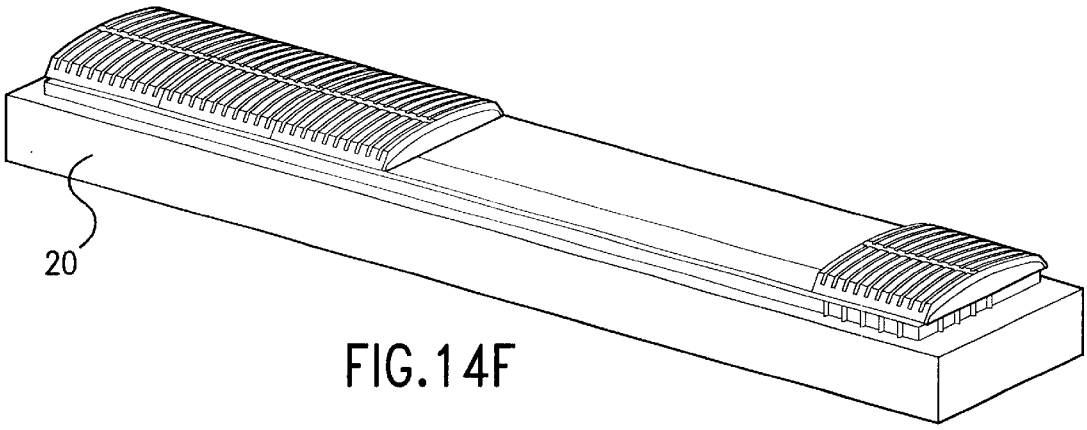
Figure 14G:
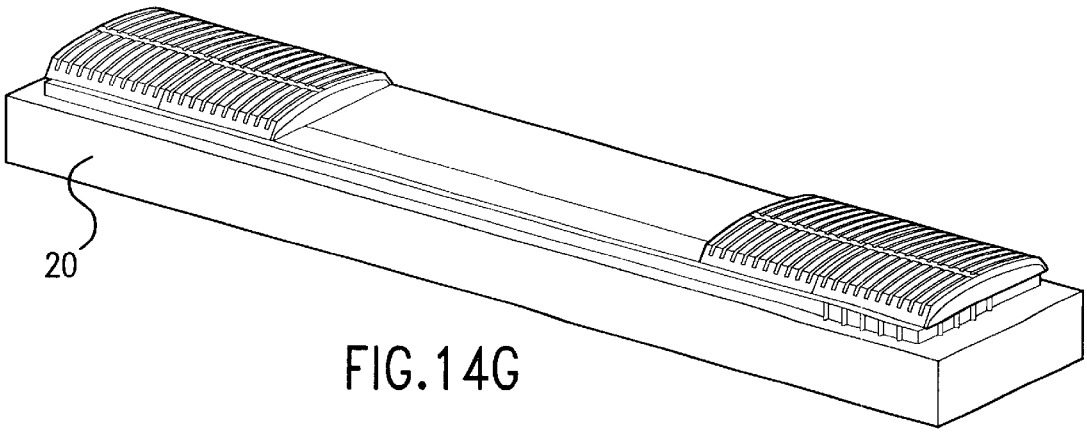

The aforementioned cover assembly 1200 may be placed in a variety of positions as shown in FIGS. 14A–G. If each low cover section is telescoped into a neighboring high cover section and pushed to one side of the barge 20 as far as possible, nearly an entire half A of the barge 20 may be exposed as shown in FIG. 14A. The exposed half A may be relocated to various portions of the barge 20 as shown in FIGS. 12B and 12C. It is also possible, although not shown in the figures, to uncover smaller portions of the barge by, for example, arranging the cover sections 1201–1208 in positions similar to those shown in FIG. 12C but separating cover section 1203 and 1202 to create open spaces on either side of cover section 1203.

Figure 15:
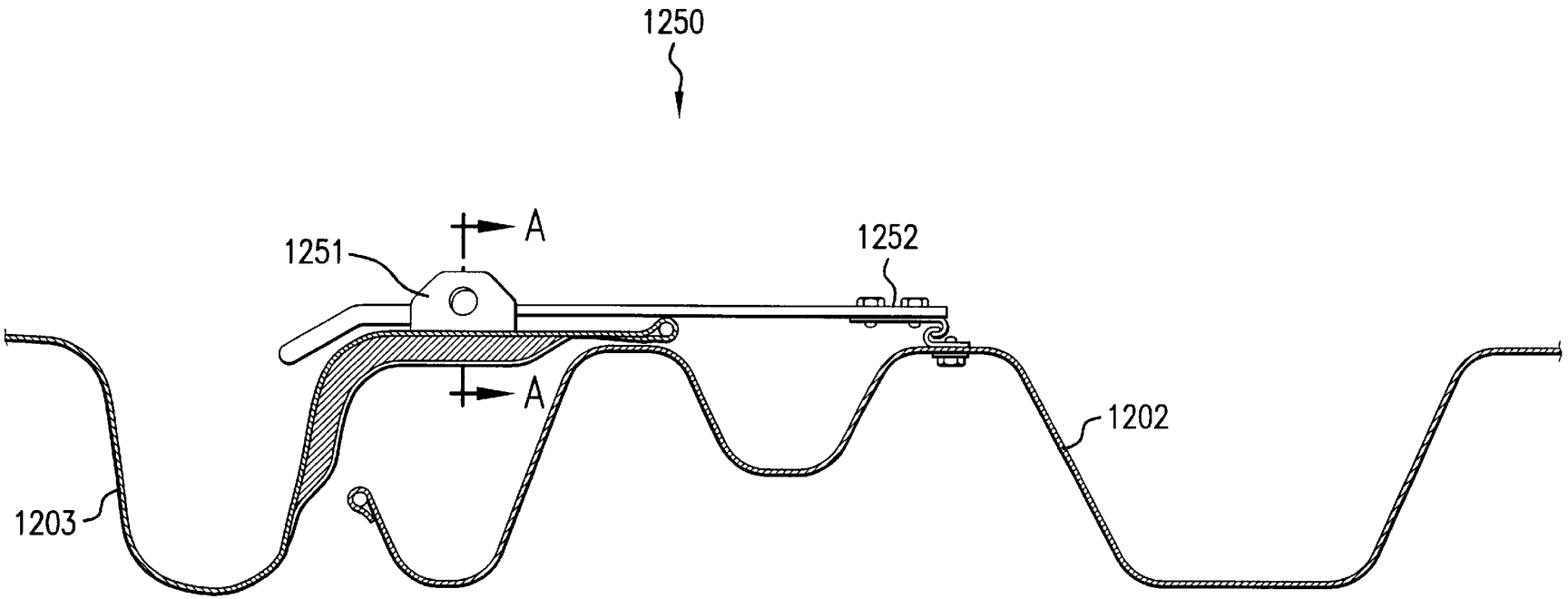
FIG. 15 is a cross sectional view showing a weather seal formed by two cover sections of the same height of the cover assembly of FIG. 12.
Figure 16:
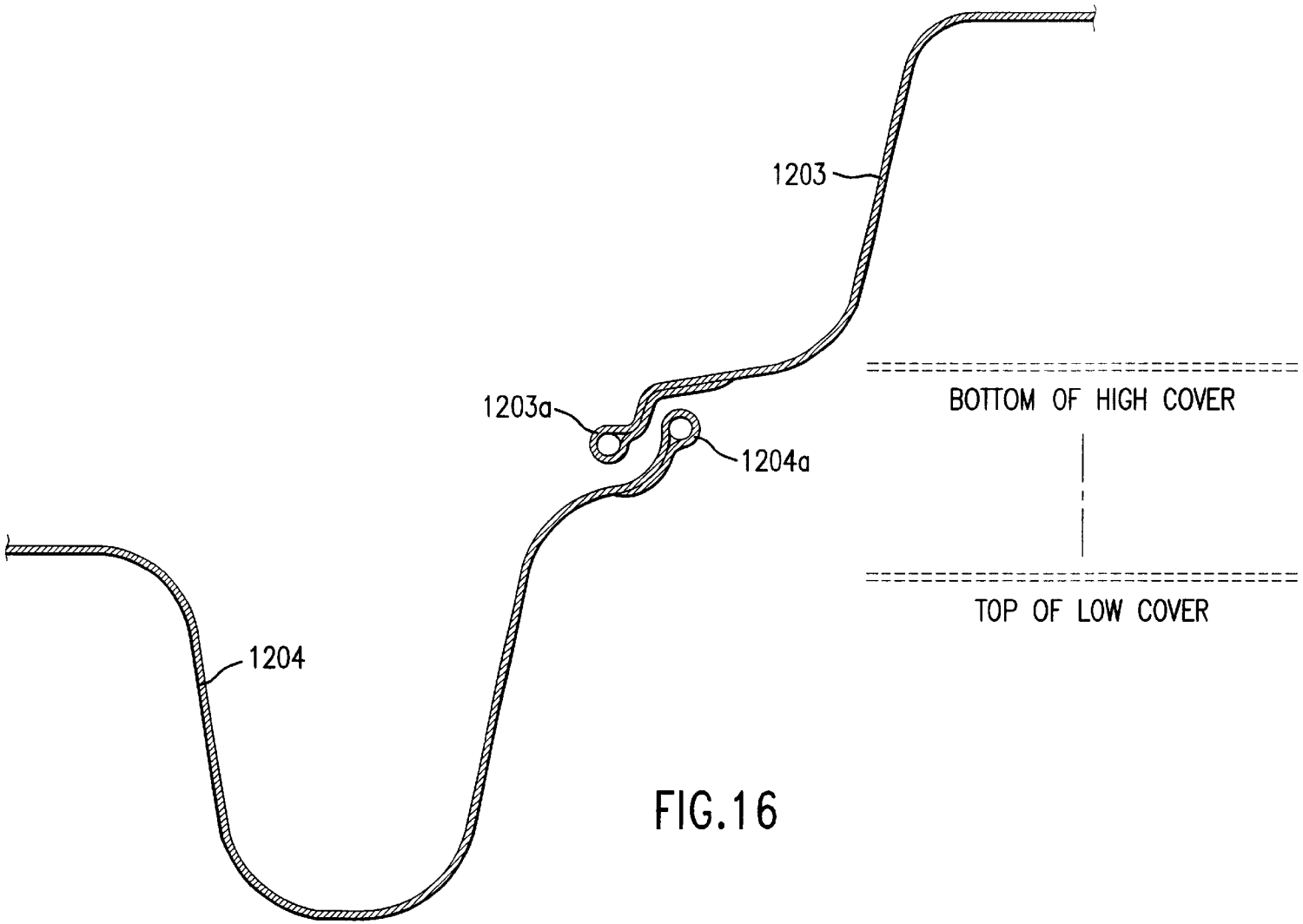
FIG. 16 is a cross sectional view showing a weather seal formed by two cover sections of different heights of the cover assembly of FIG. 12.

The cover sections 1201–1208 are provided with weather seals to protect the cargo from rainwater. As used herein, weather seals refer to edges that tend to prevent falling water from reaching cargo; a water-tight seal is not necessary for this purpose. There are two types of "joints" in cover assembly 1200: joints between covers of different heights and joints between covers of the same height. The latter is illustrated in FIG. 15. Note that cover sections 1202 and 1203 are joined by a clamp 1250 comprising the well-known arrangement of a draw bar 1252 that engages a come-along lever 1251. An example of the weather seals at the former type of joint is shown in FIG. 16, which shows a possible configuration for the joint between cover sections 1203 and 1204. It should be noted that this arrangement allows movement of cover sections 1203 and 1204 toward each other along the directions indicated by the arrows in FIG. 16. If movement in the opposite direction is desired, the ends 1203*a* and 1204*a* of cover sections 1203 and 1204 must be adjusted accordingly.

Figure 17:
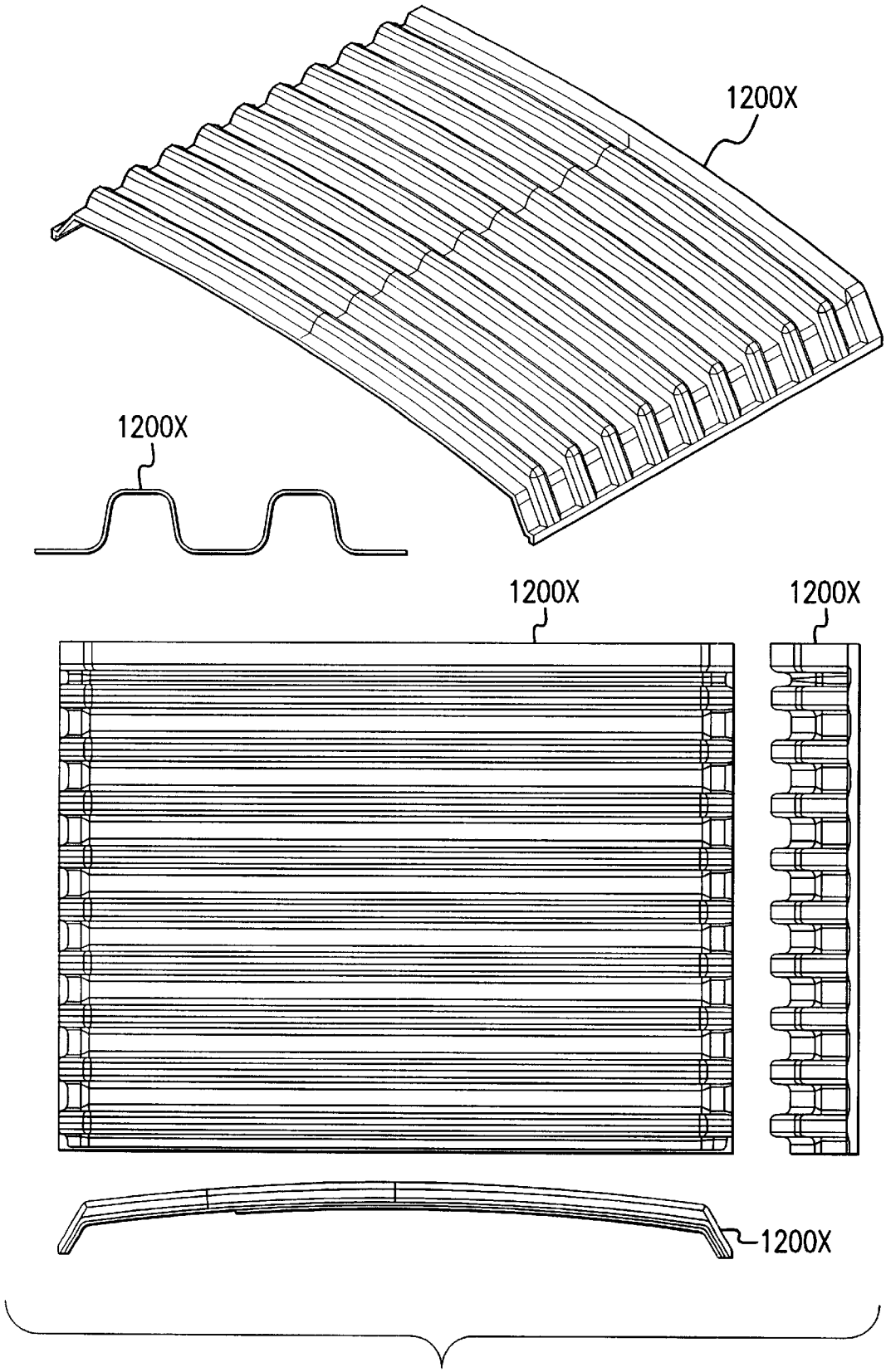
FIG. 17 is a perspective view of a cover section of the cover assembly of FIG. 12.
Figure 18:
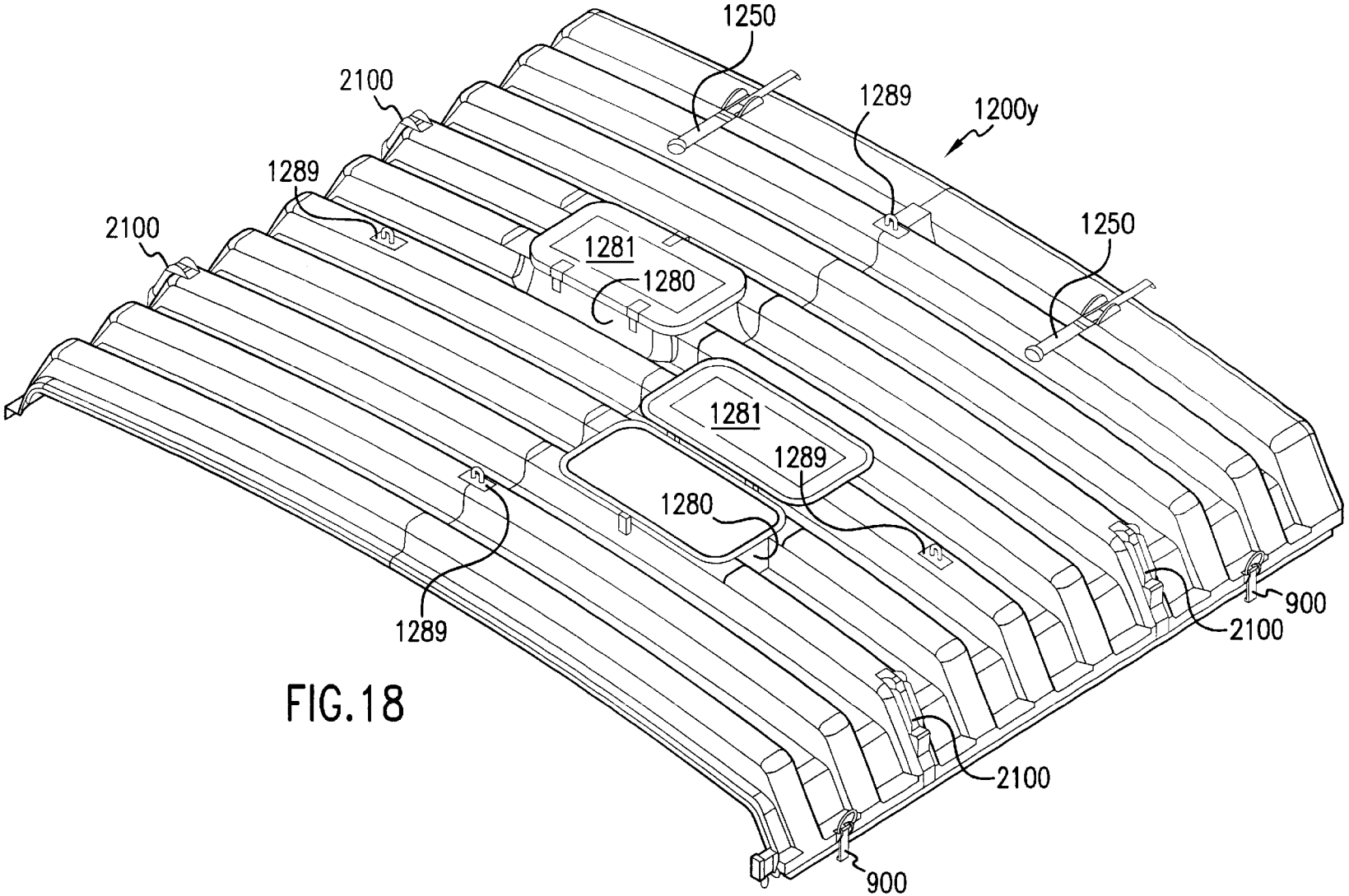
FIG. 18 is a perspective view of a cover section of the cover assembly of FIG. 12 including an opening and cover for the opening according to a seventh preferred embodiment of the present invention. Specific grain loading doors are also shown.

An exemplary cover section 1200X is shown in FIG. 17. An alternative embodiment of a high cover section 1200Y is shown in FIG. 18. Cover section 1200Y includes an access opening 1280 and cover 1281. The opening 1280 and cover 1281 provide the ability to access the cargo without moving the cover section 1200Y. The opening 1280 and cover 1281 are such that the cover 1281 is mounted substantially flush with the top of the ribs in the closed position and the cover 1281 is contoured to lie with a low profile (approximately 1 inch to 3 inches) in the open position so that little or no additional clearance for an overlying cover section is necessary when the cover 1281 is in either the open or closed position. Although providing an opening 1280 on a movable cover 1200Y is counter-intuitive, experience has shown that an opening 1280 will allow sufficient access for many purposes, the most common being grain loading. Thus, the opening 1280 saves wear and tear on the cover section 1200Y. It will be apparent to those of ordinary skill in the art such openings may be provided with any of the embodiments discussed herein. Cover section 1200Y also includes lifting rings 1289, which may be used in addition to rings associated with anti-derailment clamps provided with some or all of the various cover sections discussed herein. The lifting rings may be arranged such that, when ropes of equal length tied to a central point overhead of the cover section are used to lift the cover section, the sides of the cover sections are urged away from the tracks 32, 33 to ease lifting.

Figure 19:
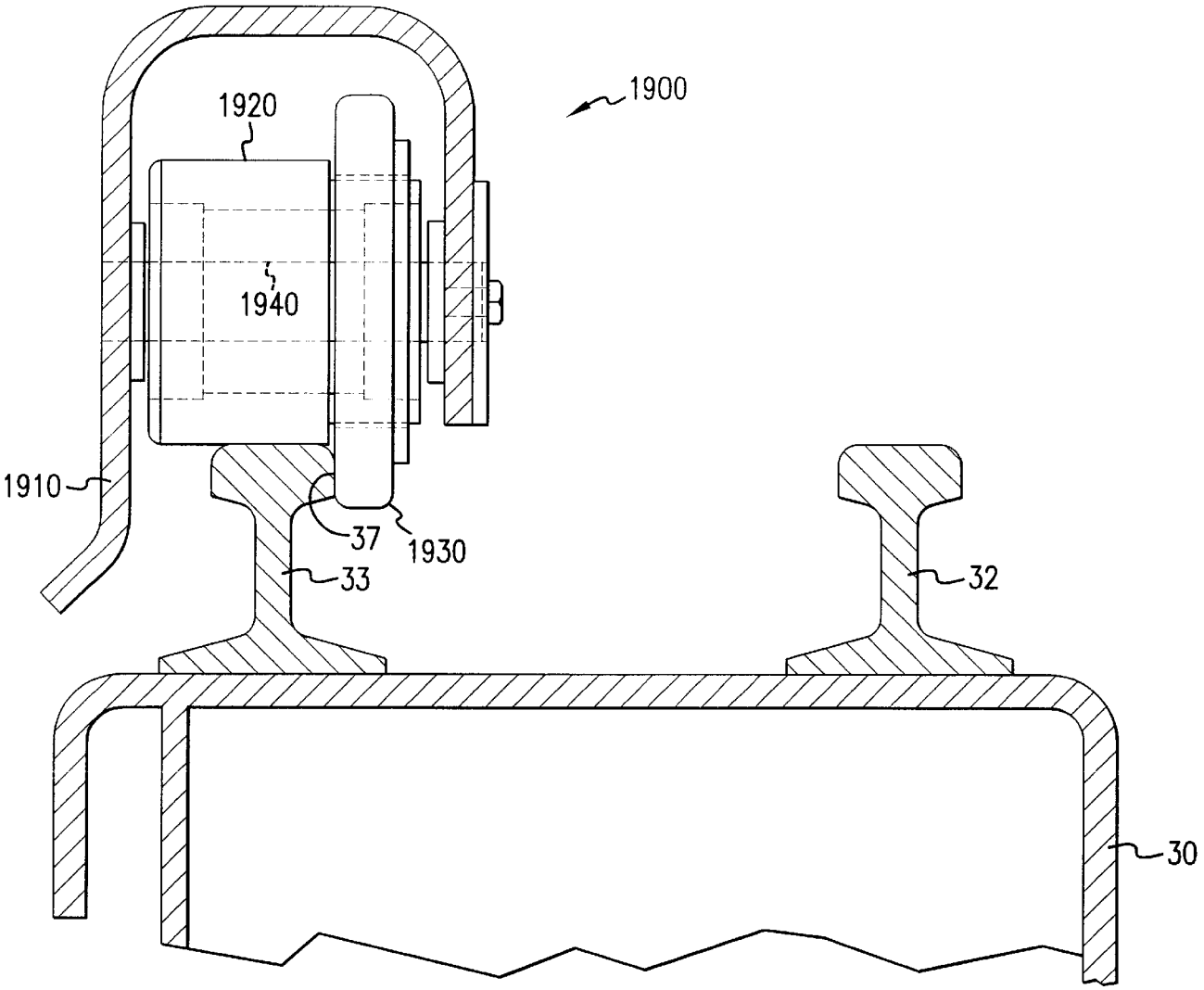
FIG. 19 is a side view of a wheel assembly for a cover section according to an eighth preferred embodiment of the present invention.
Figure 20:
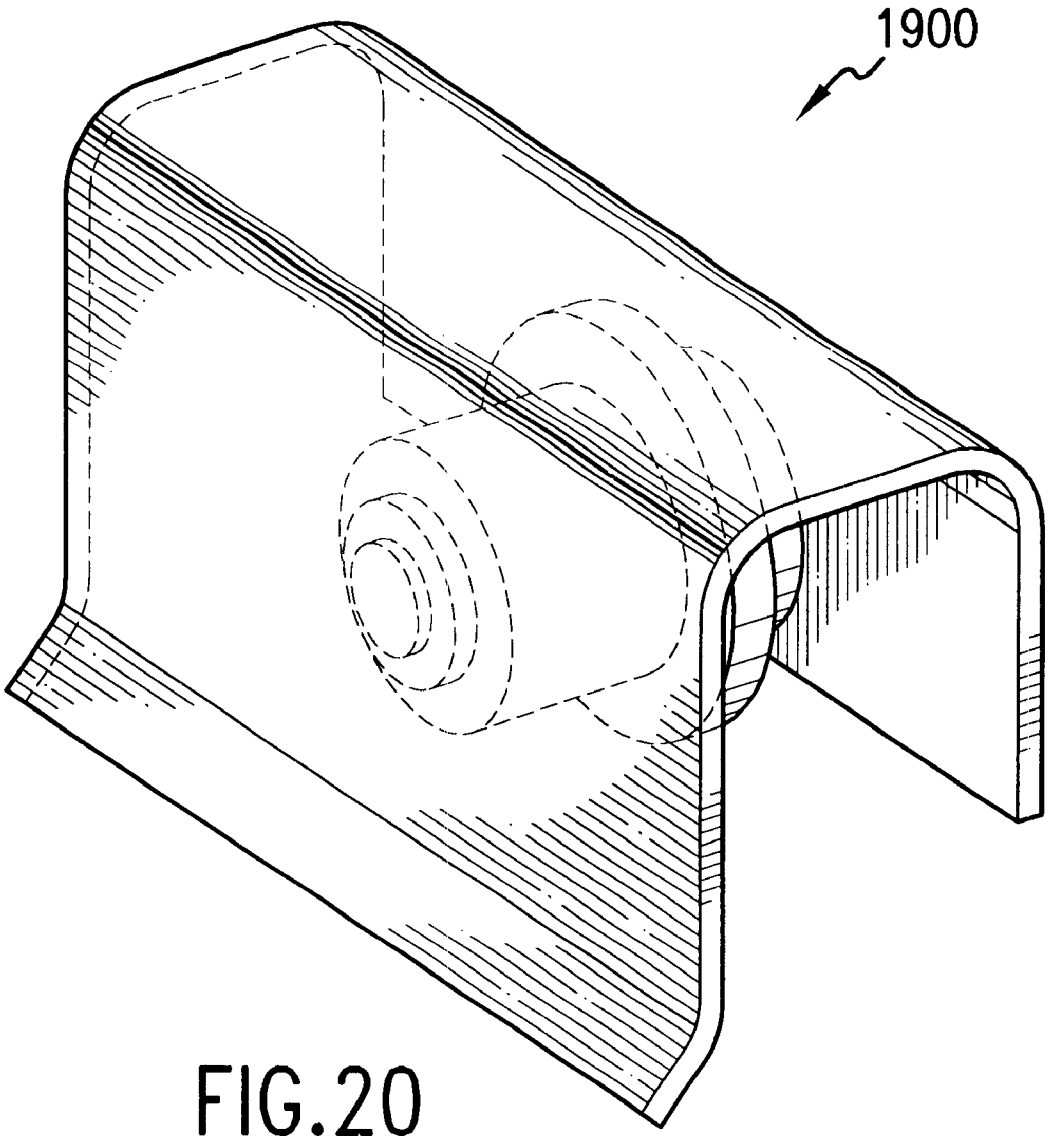
FIG. 20 is a perspective view of the wheel assembly of FIG. 19.

An alternative roller and track assembly 1900 is illustrated in FIG. 19. The assembly includes a channel 1910 in which is disposed a weight bearing wheel 1920 and a guide wheel 1930. The guide wheel 1930 is mounted on the same axle 1940 as the weight bearing wheel 1920, but is of a larger diameter such that it is in contact with the vertical surface 37 of the track 33. The guide wheel 1930 replaces the separately mounted guide wheel 216 of FIG. 4. The guide wheel 1930 is preferably comprised of a low-friction material such as a hard plastic. The guide wheel 1930 may rotate independently of the weight bearing wheel 1920 so that the wheels do not "walk" off the track 33 if the assembly 1910 and track 33 become misaligned. Although the cross-sectional view of FIG. 19 shows the guide wheel 1930 as symmetrical, the guide wheel 1930 may also have a trapezoidal cross-sectional shape, with the larger end furthest from the weight bearing wheel 1920. A perspective view of assembly 1900 is shown in FIG. 20.

Figure 27A:
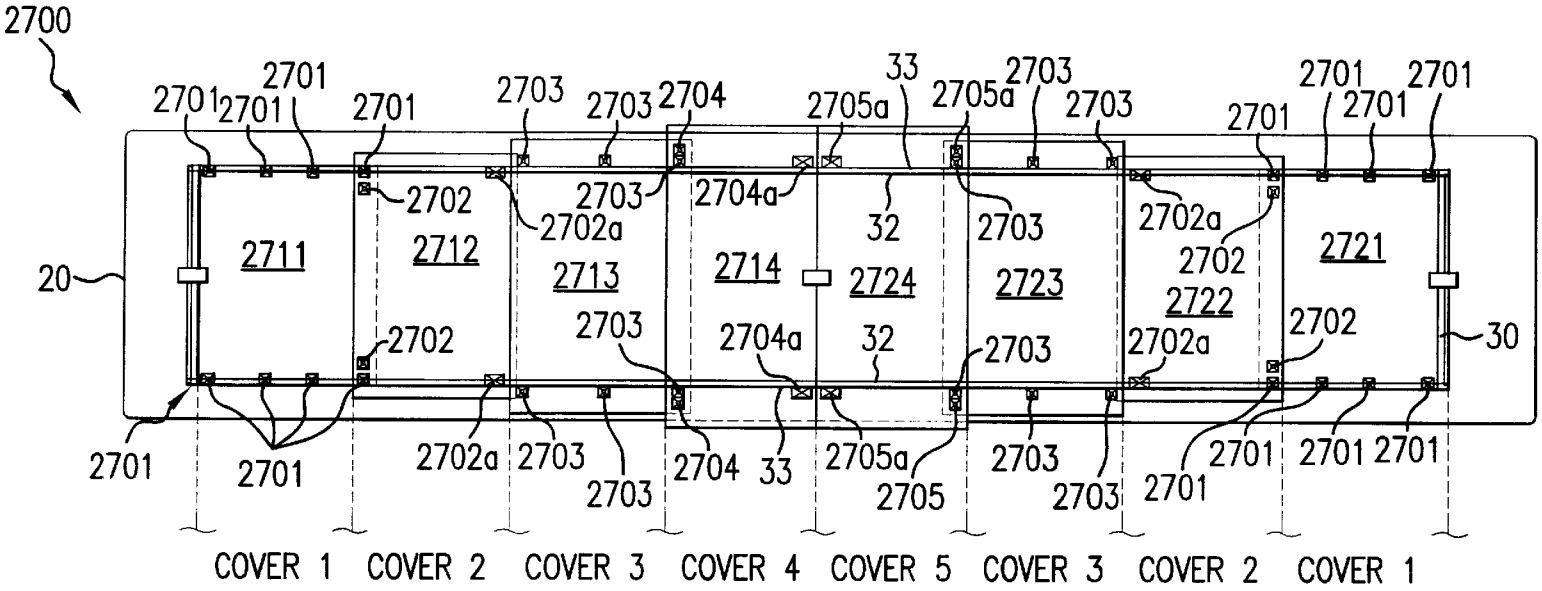
FIGS. 27A and 27B are top and side views, respectively, of another embodiment of a cover set according to the present invention.
Figure 27B:
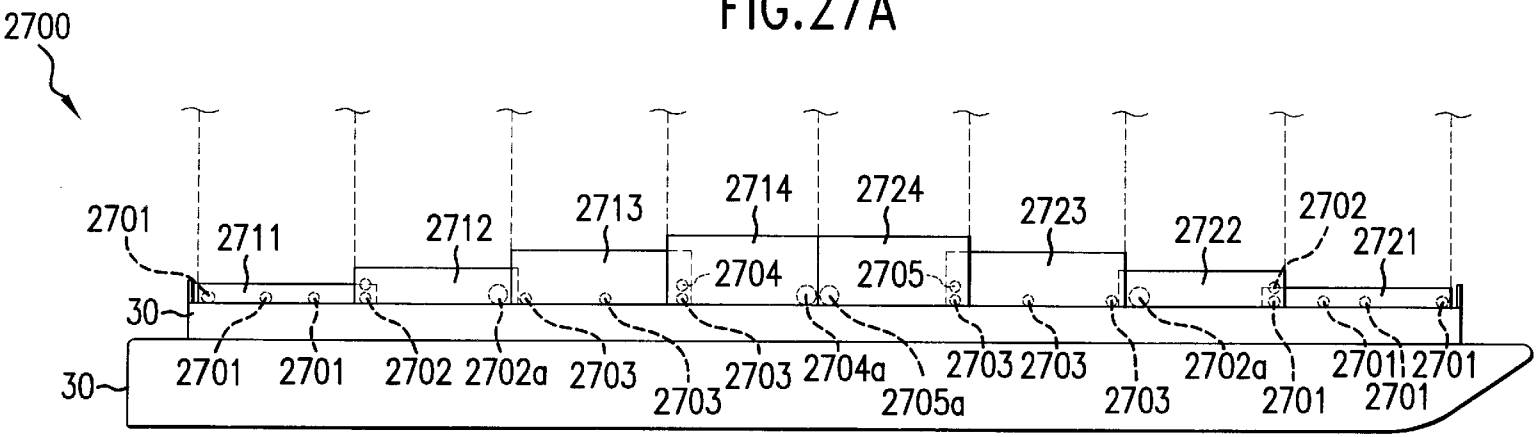

Yet another embodiment of the invention is shown in FIG. 27, which illustrates a cover assembly 2700 installed on a barge 20. The cover assembly 2700 comprises two sets of covers, one set comprising covers 2711, 2712, 2713 and 2714; the other set comprising covers 2721, 2722, 2723 and 2724. The cover assembly 2700 is designed to ride on two tracks 32, 33 on the coaming 30, much like previous embodiments discussed herein. Thus, covers 2711, 2713, 2723 and 2721 some are adapted such that all wheels ride on the respective tracks 32, 33 on the coaming 30. However, covers 2712, 2714, 2724 and 2722 are adapted such that the center most front wheels 2702*a* and 2704*a* ride on the respective tracks 32, 33 while the rear wheels 2702 and 2704 ride on tracks attached to the underlying covers 2711, 2713, 2723, 2721 respectively. The center most wheels 2702*a*, 2704*a* are larger than the rear wheels 2702, 2704 on the covers 2712, 2714, 2722 and 2724 in part to compensate for the different heights at which these wheels must be mounted to the covers. In preferred embodiments, the large wheels are approximately 10" in diameter, while the small wheels are approximately 3½" in diameter.

Figure 28A:
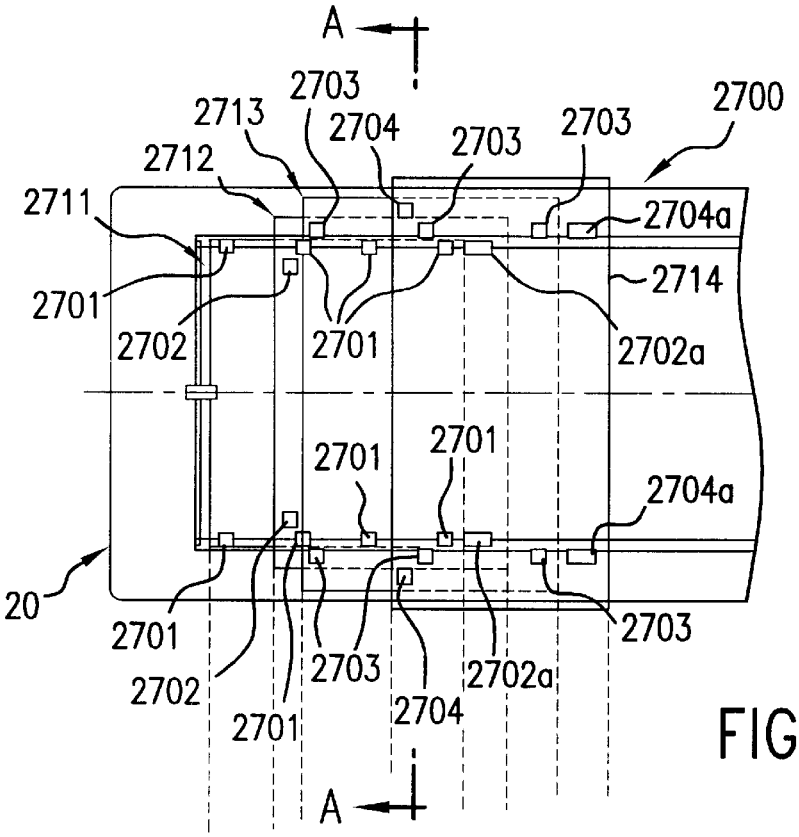
FIGS. 28A and 28B are top and side views, respectively, of a portion of the cover set FIG. 27.
Figure 28B:
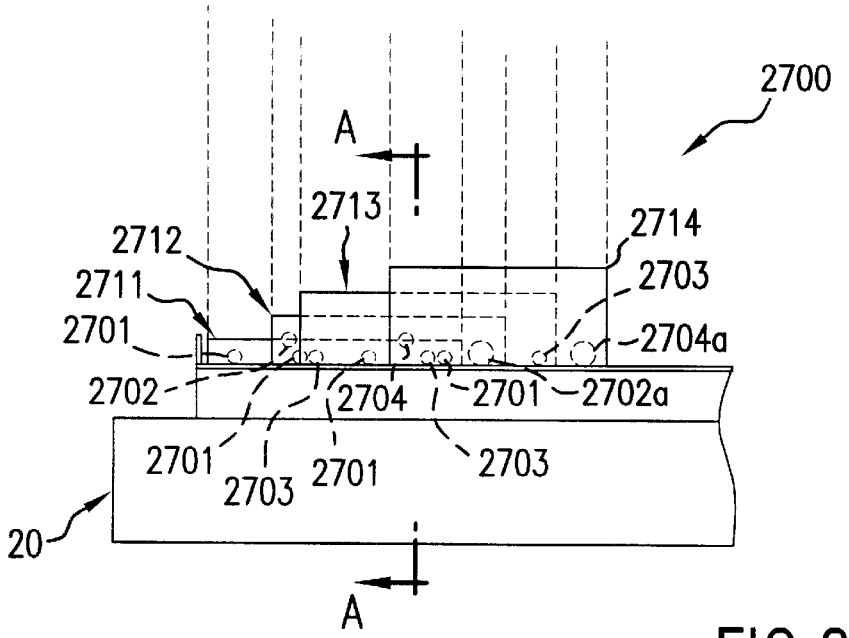

FIG. 28 illustrates one-half of the cover set 2700 in a partially telescoped position. Although FIG. 28 shows cover 2713 positioned to the right of cover 2712, in the fully-telescoped position, cover 2713 can be positioned as far left as cover 2711.

Figure 29:
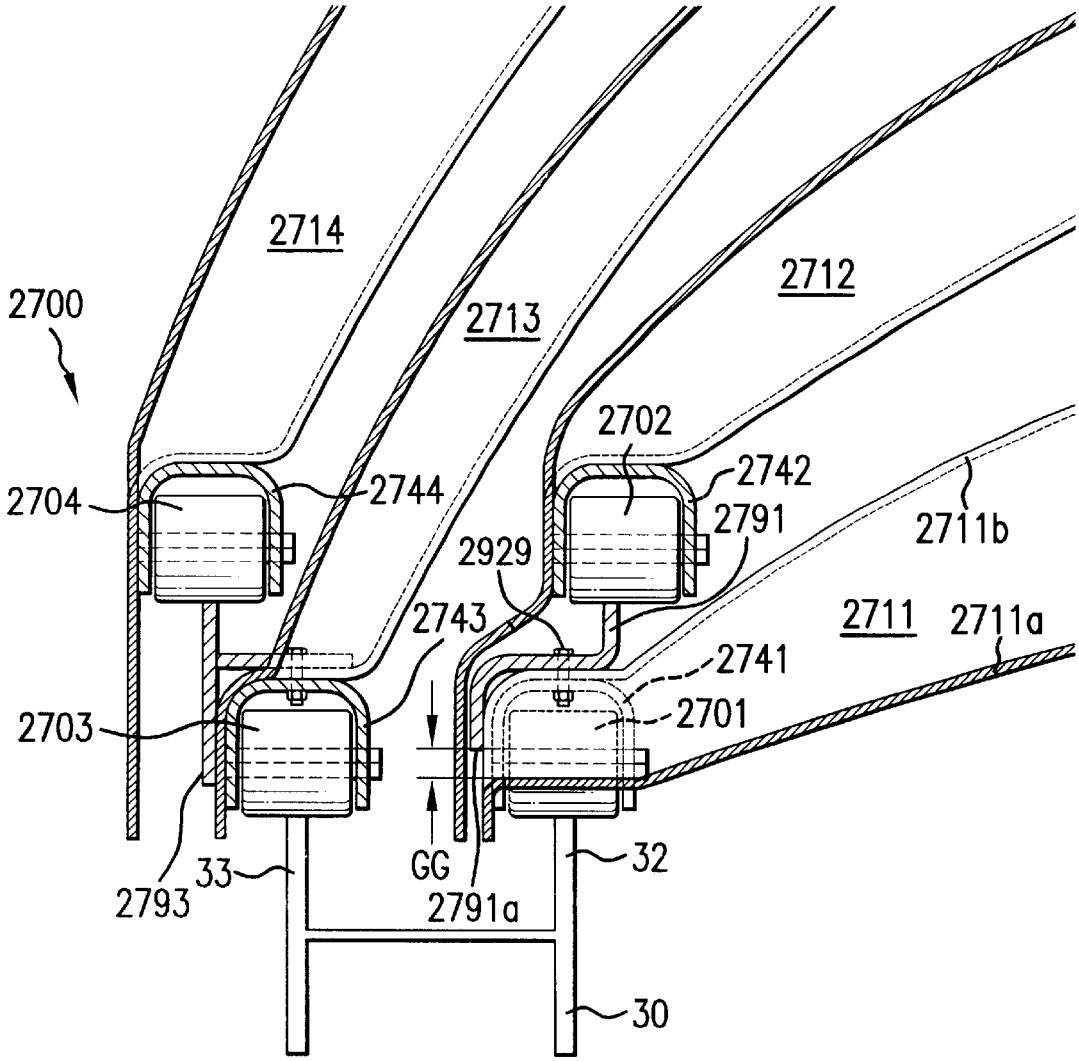
FIG. 29 is an end view of the portion of the cover set FIG. 28.

FIG. 29 is an end view of the portion of the covers that 2700 illustrated in FIG. 28. Track 2791, upon which the rear wheels 2702 of cover 2712 ride, is attached to cover 2711. Cover 2711 includes ribs, similar to those shown for cover 2714 in FIG. 30. The track 2791 is attached to the top 2711*b* of the ribs by a fastener 2929, which also secures wheelbox 2741 to cover 2711. (A similar arrangement exists for track 2793, wheelbox 2743 and cover 2713.) In order to allow rain water to drain from the valleys 2711*a* between the ribs on cover 2711, a gap GG is left between the valleys 2711*a* and the end 2791*a* of the track 2791.

Figure 30:
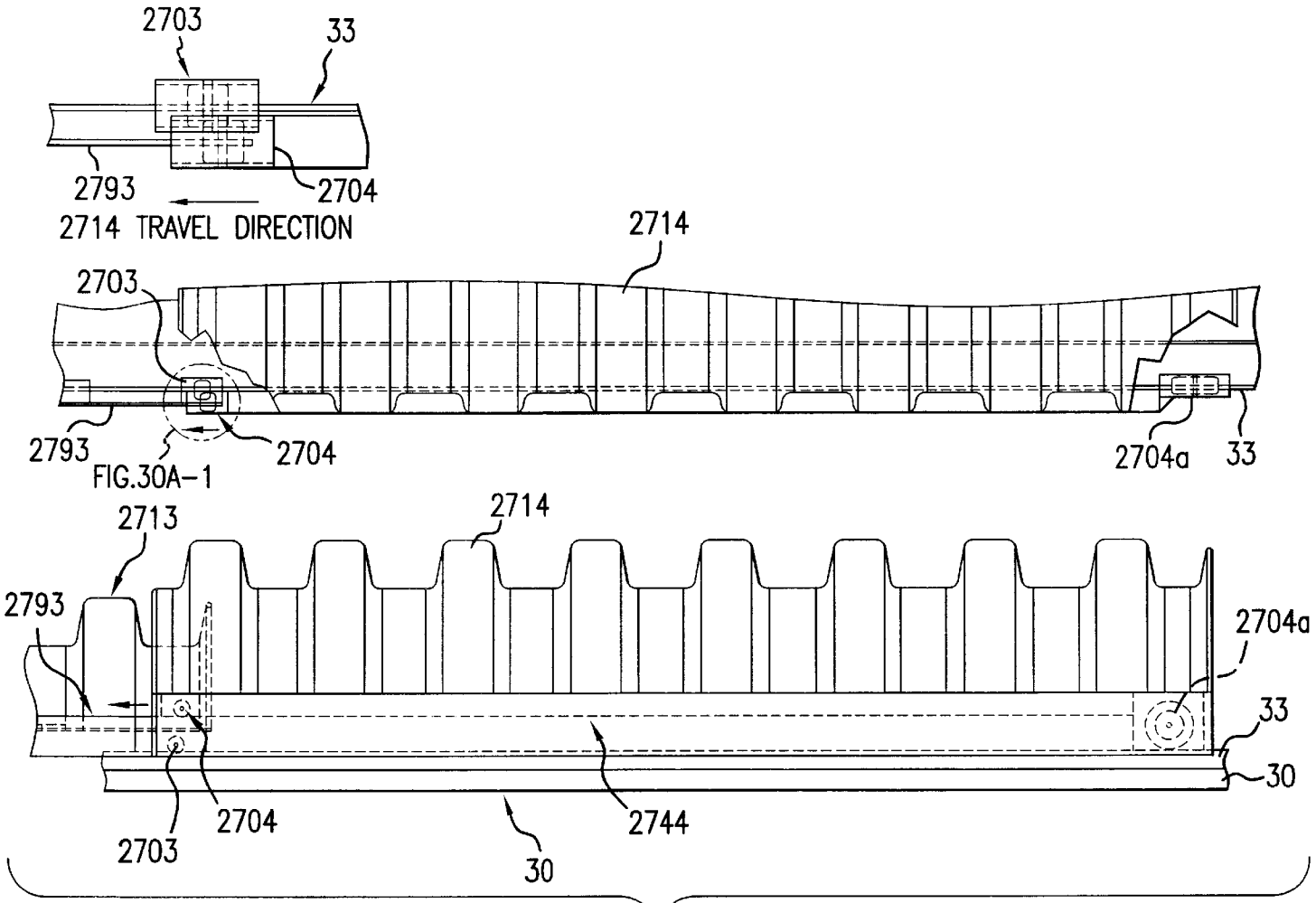
FIG. 30 is a side view of two of the covers of the cover set shown in FIG. 27.
Figure 31:
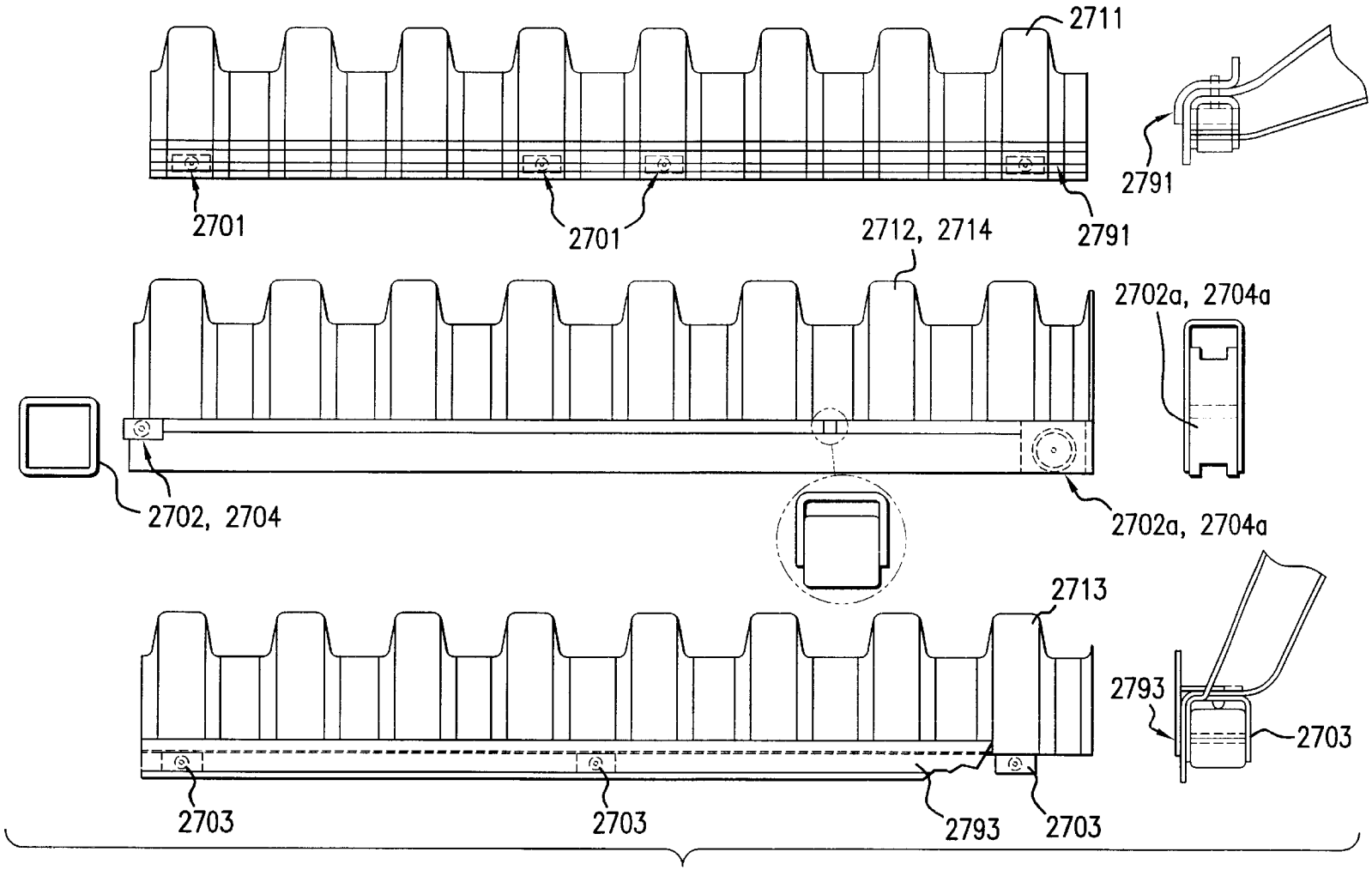
FIG. 31 is a side view of the covers of the cover set of FIG. 27 in their truck configurations.

FIG. 30 illustrates the interaction between the outer covers, covers 2713 and 2714. The interaction for covers 2711 and 2712 is similar. FIG. 31 illustrates side views of covers 2711 through 2714 showing their truck configurations. (Truck refers to the steel portion of a cover that houses the wheels.)

Figure 32A:
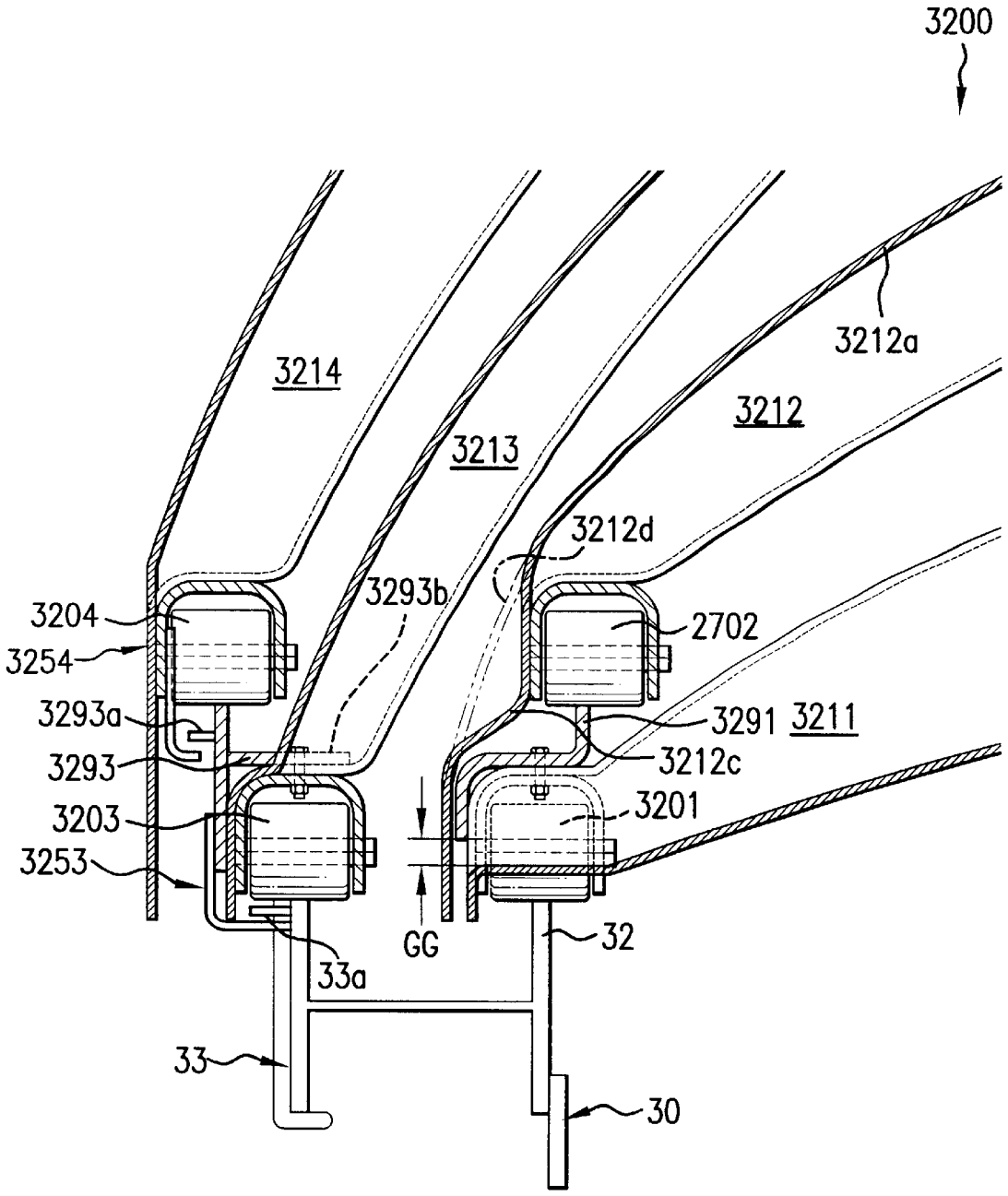
FIG. 32A is an end view of another embodiment of a cover set according to the present invention.

FIG. 32 illustrates a cover set 3200, which is a variation of the cover at 2700 discussed above. The cover set 3200 has been adapted to prevent covers 3211–3214 from being blown off the tracks 32, 33 in high-wind conditions. This is accomplished through the addition of an L-bracket 3254 to cover 3214 and a second L-bracket 3253 to cover 3213. (There are identical L-brackets 3253, 3254 on the opposite sides of covers 3203 and 3204, respectively). L-bracket 3254 engages a lip 3293*a* which protrudes from the track 3293 attached to cover 3213. Similarly, L-bracket 3253 engages a lip 33*a* attached to track 33. The L-brackets 3253, 3254 prevent covers 3213 and 3214 from being blown off in high wind. The covers 3211 and 3212 are prevented from being blown off by covers 3213 and 3214. It should be noted that the primary danger of covers being blown off the track occurs when the covers are in the open or telescoped position. Accordingly, no separate provisions are made for securing covers 3211 and 3212 as they are held in place by covers 3213 and 3214 when in the telescoped position. Also illustrated in FIG. 32*a* is line 3212*d* which represents the normal curvature of the top portion 3212*a* of ribs which do not include an indented portion 3212*c* adapted to engage the wheel assembly 3212. Although a similar phantom line was not shown for cover 2702 of cover set 2700, it should be noted that covers 3212 and 2702 are similar in this regard. Also illustrated in FIG. 32*a* is an extended portion of 3293*b* of track 3293 which extends between ribs and into the valleys of cover 3213. Similar arrangements can be made for embodiments of cover sets discussed in this application.

Figure 32B:
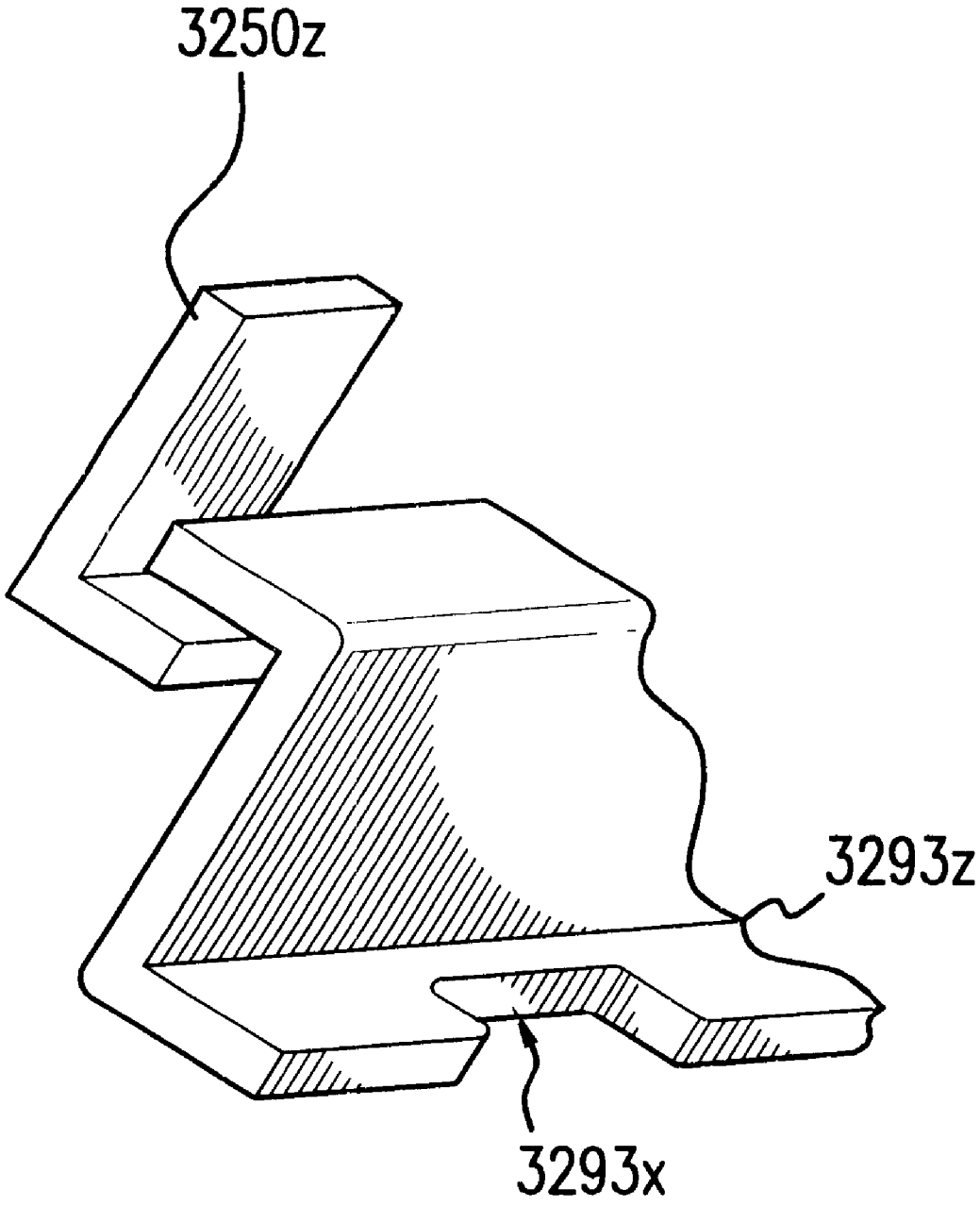
FIG. 32B is an alternate embodiment of a portion of the cover set of FIG. 32.

FIG. 32*b* illustrates an alternate embodiment of the track 3293 and L-brackets 3254 of FIG. 32*a*. In this embodiment, the track 3293Z is Z shaped. The track 3293Z includes indentations 3293X designed to fit around ribs in a manner similar to the way extension 3293*b* in FIG. 32*a* fits around ribs of cover 3213. While the track 3293Z in FIG. 32*b* is continuous, the L-brackets 3250Z are not continuous—they are only a few inches wide in preferred embodiments.

Although the various embodiments discussed above may be rolled and telescoped to varying degrees, there are some occasions on which it is desirable to remove the cover sections from the barge entirely. The anti-derailment clamps discussed herein provide for this ability. Because dock space is often scarce, it is desirable to stack covers on the dock when they are removed from the barge. A serious concern when removing cover sections is to avoid damage to the covers during the stacking and unstacking processes and to keep the covers securely stacked so that they are not blown off by wind.

Figure 21:
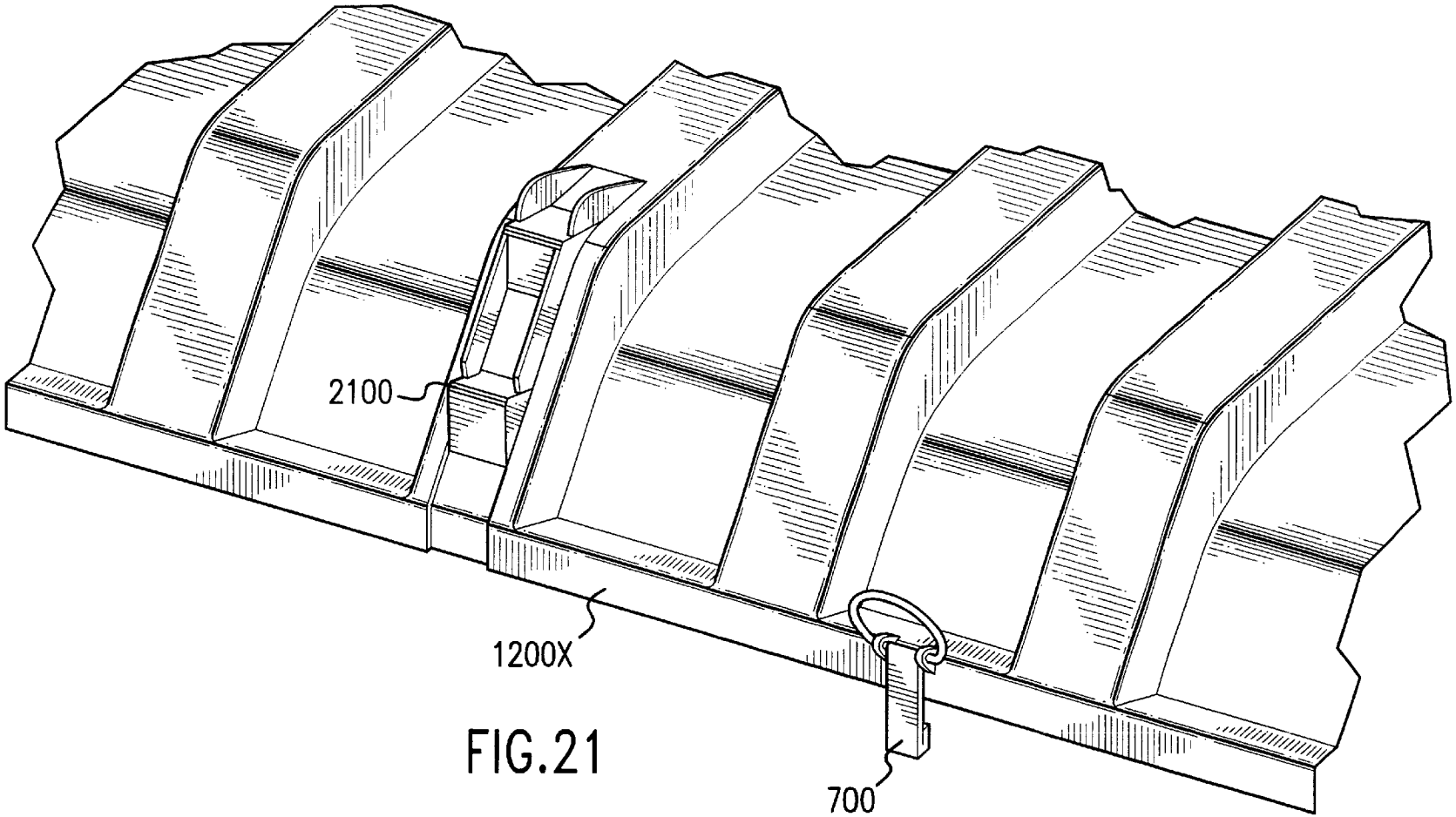
FIG. 21 is a perspective view of a cover section including a stacking shelf according to a ninth preferred embodiment of the present invention.
Figure 22A:
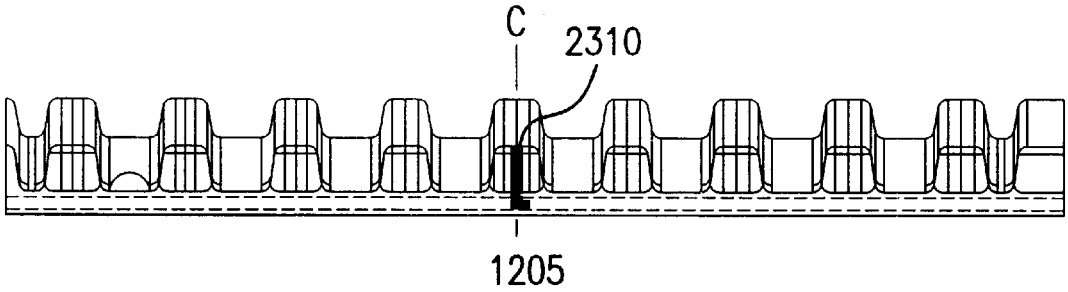
FIGS. 22A–22E are side views of the cover assembly of FIG. 12 showing the covers individually (22A–D) and stacked 22E.
Figure 22B:
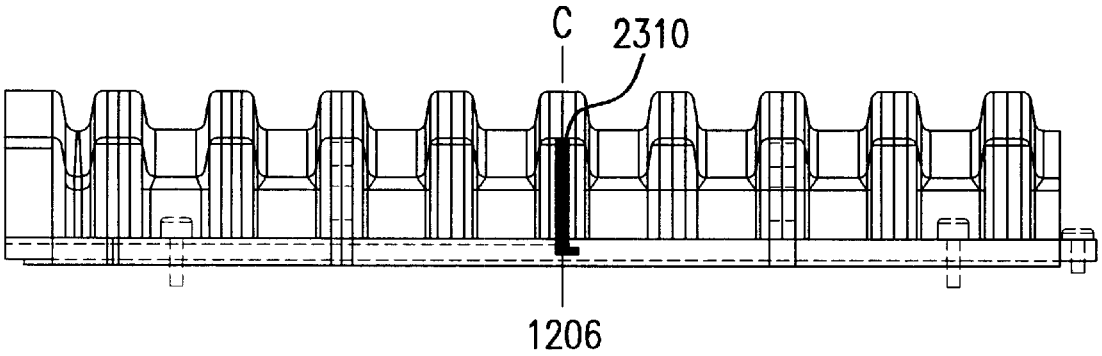
Figure 22C:
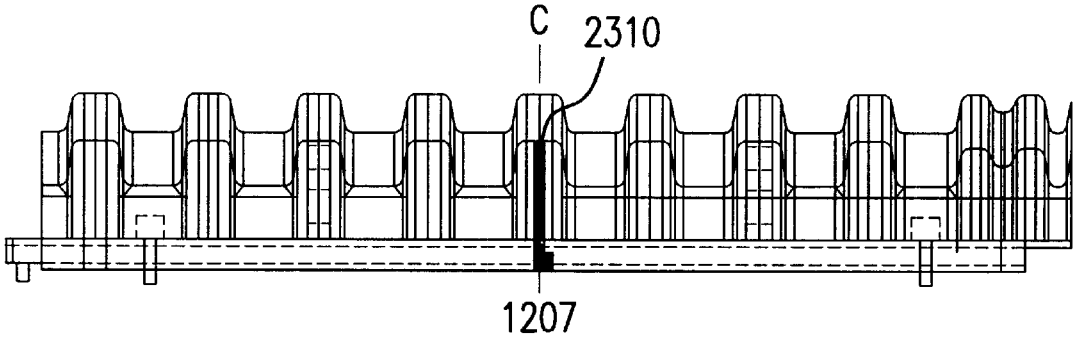
Figure 22D:
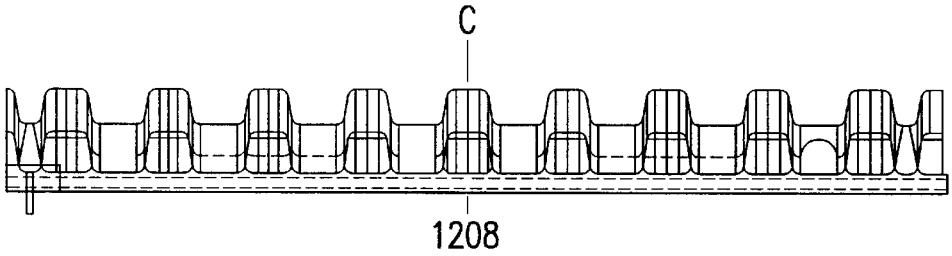
Figure 22E:
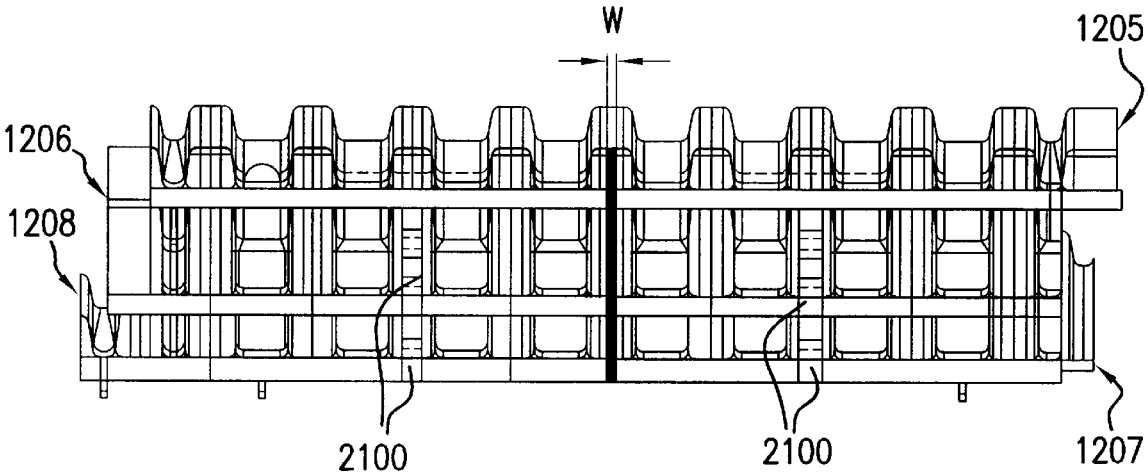

One way to avoid damage to a cover section 1200X is to provide stacking shelves such as the stacking shelf 2100 as shown in FIG. 21. The stacking shelf 2100, on which rests a channel from an overlying cover section, keeps stacked cover sections 1200X out of contact with other sections 1200X when stacked, thereby avoiding damage to the cover sections 1200X resulting from, for example, contact with the anti-derailment clamp 900 of underlying cover sections. An example of the use of stacking shelves is 2100 for the covers 1205–1208 of FIG. 12 is shown in FIG. 22. Low end cover section 1208 is at the bottom of the stack. High cover 1207 is placed on top of low cover section 1208 such that the cover sections 1207 and 1208 are staggered, thereby avoiding any possible damage to the ends of the cover sections which form weather seals. Because high cover section 1207 is designed to be rolled over low cover section 1208, there is no danger of contact (except at the ends) between the covers and therefore no stacking shelf is required for low cover section 1208. However, cover section 1207 is provided with stacking shelves 2100 because high cover section 1206 (of the same approximate width and height) is to be stacked on top of it. Cover sections 1206 and 1207 are also staggered with respect to each other, again to avoid damage to the weather seal ends. In order to facilitate the staggered alignment, alignment stripes 2310 of width W are provided on the cover sections 2306, 2307. Stacking shelves are also provided on cover section 2306 to receive cover section 2305, which is a low section. A stripe 2310 is also provided on cover section 2305 to facilitate the staggered alignment.

Figure 23:
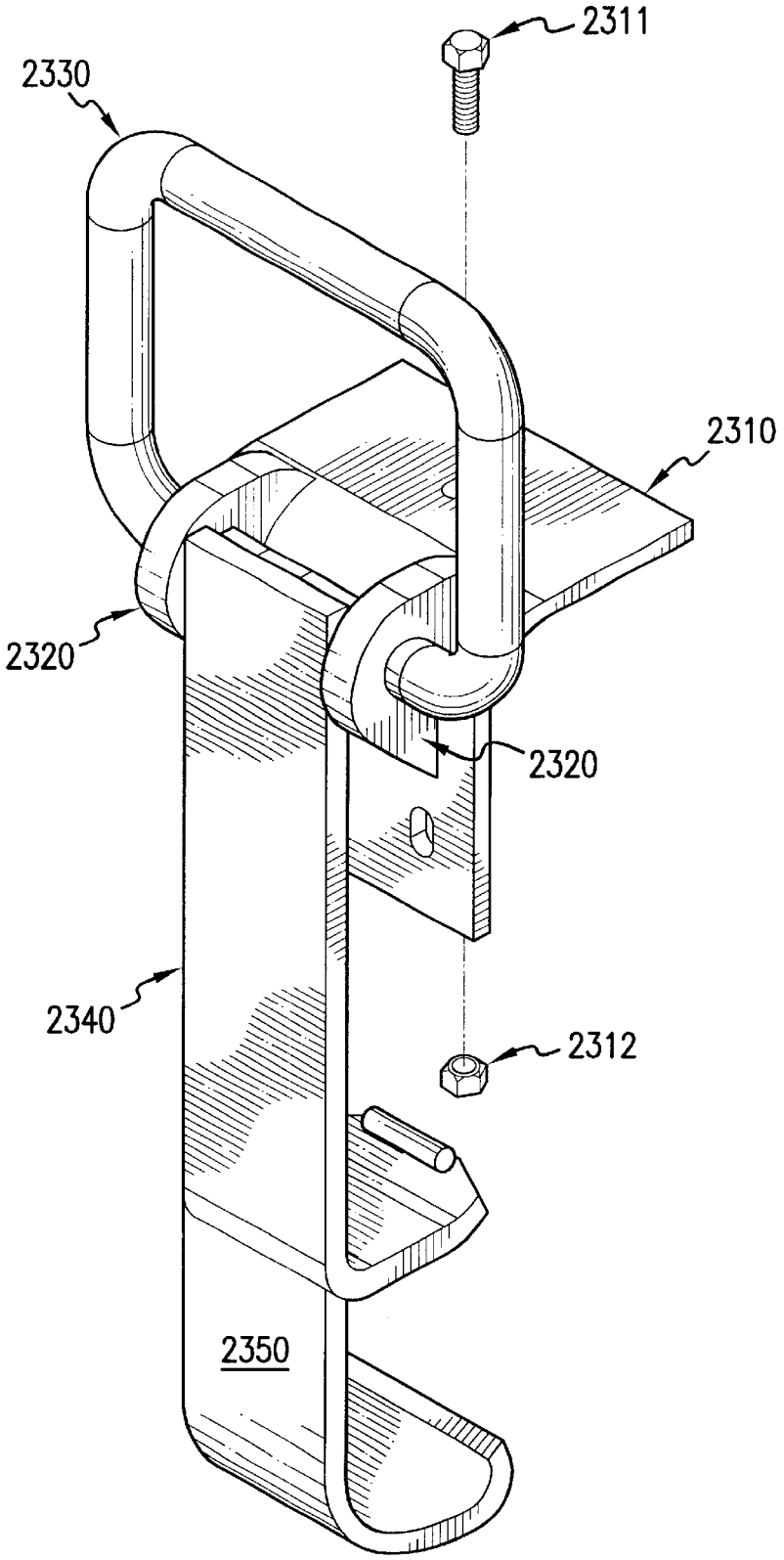
FIG. 23 is a perspective view of an anti-derailment clamp including a wind latch extension according to a tenth preferred embodiment of the present invention.
Figure 24:
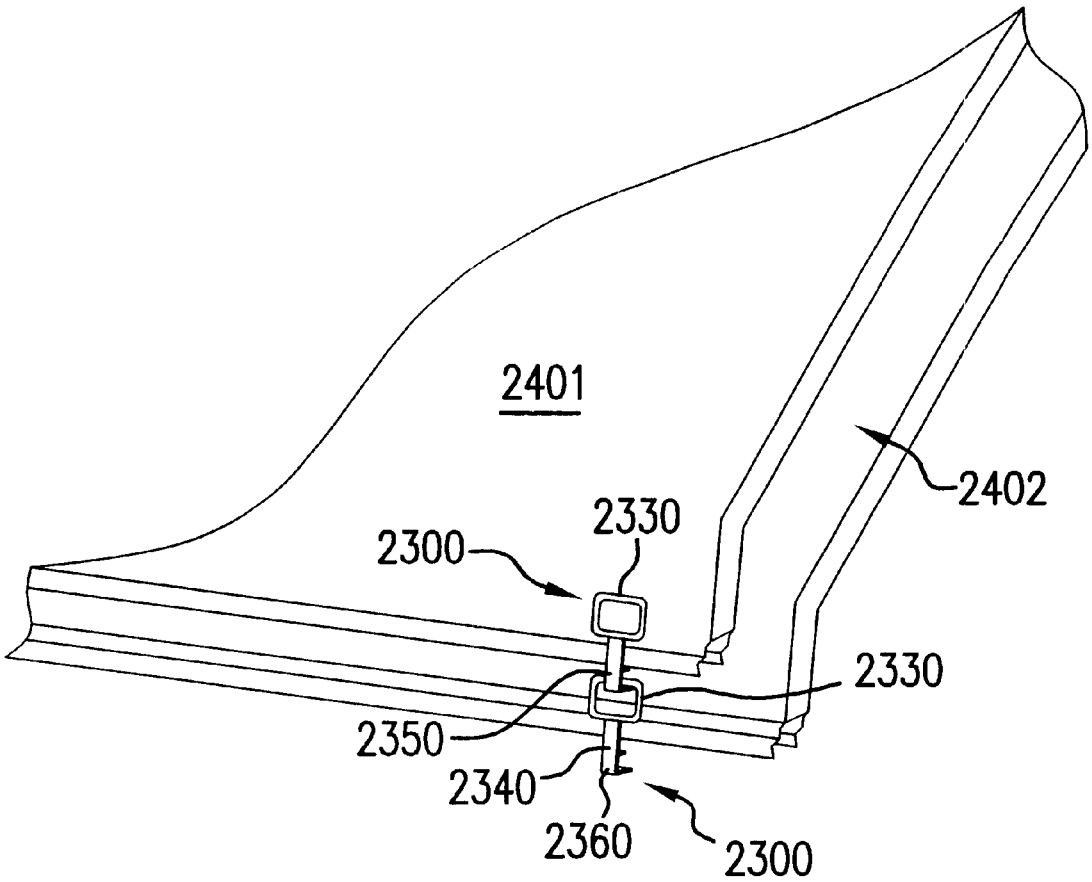
FIG. 24 is a perspective view of cover sections showing the anti-derailment clamp of FIG. 23 of a top cover section engaging an anti-derailment clamp of an underlying cover section.

Because T & R covers manufactured from materials such as FRP are light weight, when stacked or spread on the barge they may be blown off by wind. As discussed above, known FRP T & R covers must be secured using separate cables—there is no provision on the covers themselves to tie the cover sections down when in the stacked position. Preferred embodiments of the present inventions solve this problem by providing anti-derailment clamps 2300, as shown in FIG. 23, with wind latch extensions 2350 on the engaging bar 2340 that engage the rings 2330 of anti-derailment clamps of underlying cover sections. The anti-derailment clamps 2300 are similar to the anti-derailment clamps 700 of FIG. 7 except for the wind latch extensions 2350. FIG. 24 depicts a partial view of two stacked cover sections 2401, 2402 of the same size, with the wind latch extension 2350 of the upper anti-derailment clamp 2300 engaging the ring 2340 of the lower anti-derailment clamp 2300.

Figure 26A:
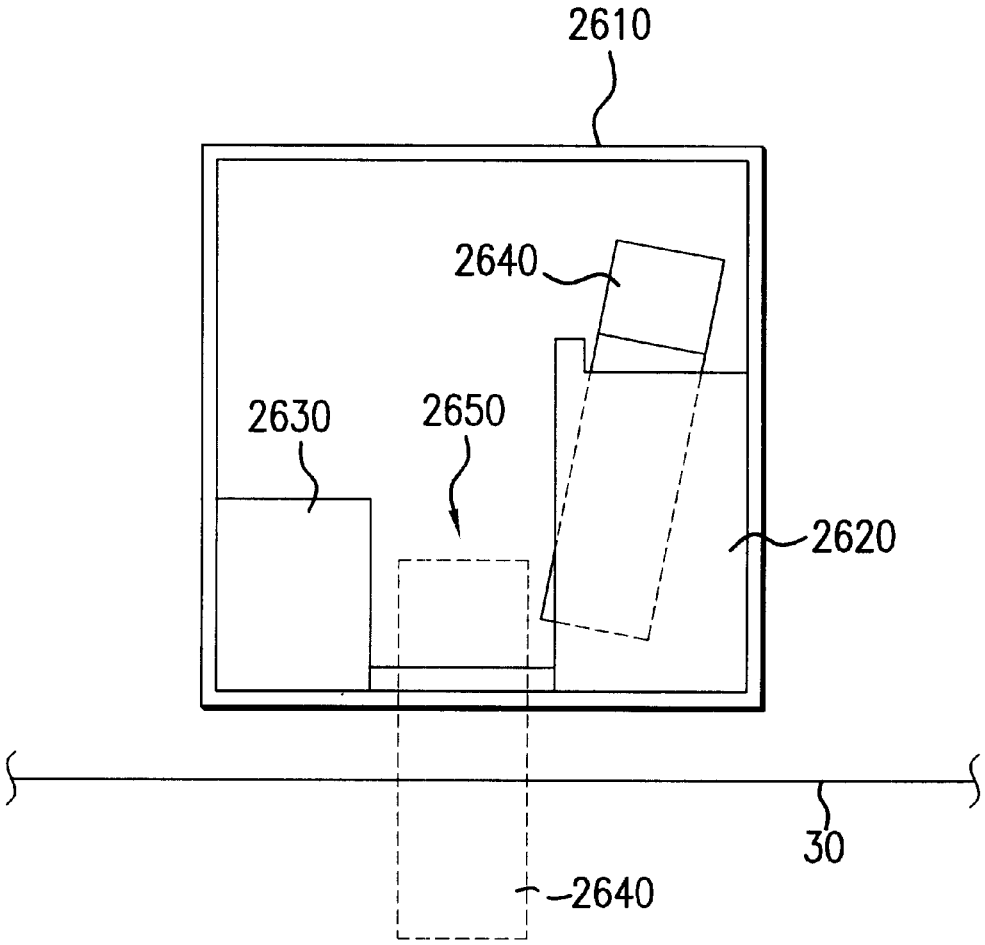
FIGS. 26A and 26B are side and perspective views, respectively, of a dagger pin assembly according to the present invention.
Figure 26B:
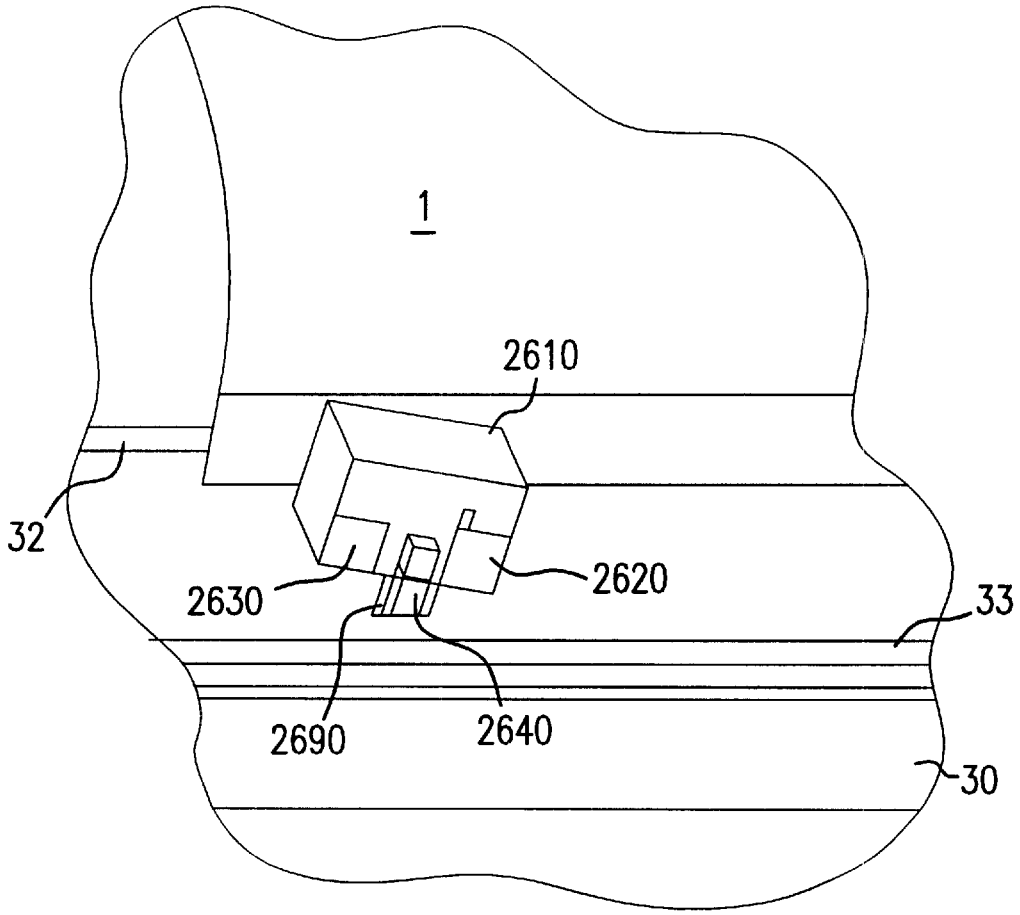

The telescoping cover sections described above must be held in position in some manner to the preferred embodiments. This is accomplished through use of a dagger pin assembly 2610 attached to cover 1, as shown in FIGS. 26A and 26B. The dagger pin assembly 2610 includes a rest shelf 2620 on which a moveable dagger pin 2640 may be rested in a position such that it does not impede movement of the cover 1 along coaming 30. The dagger pin assembly 2610 also includes a guide 2630, which together with the shelf 2620 define a channel 2650 into which the dagger pin 2640 may be lowered so that the dagger pin 2640 engages a hole 2690 in the coaming 30, thereby preventing movement of the cover 1. Dagger pin assemblies 2610 may be provided on all covers and/or only on one side of all covers or a single cover.

Figure 25A:
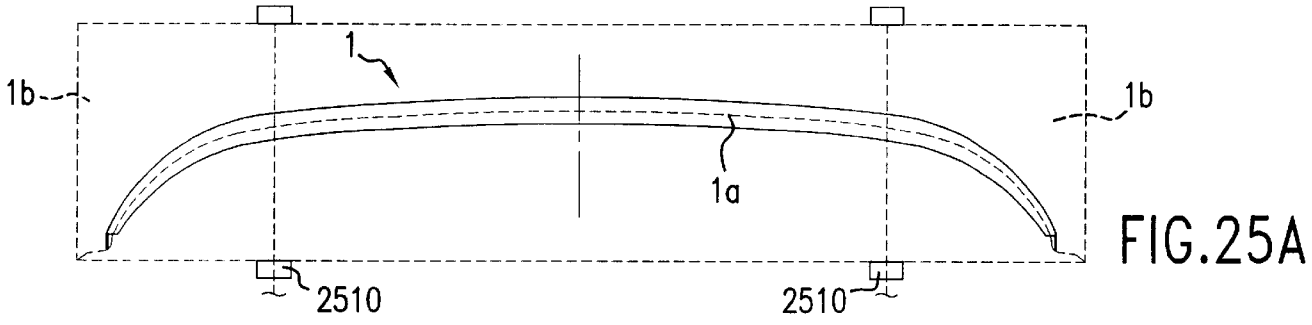
FIGS. 25A and 25B are side and top views of molds used in making a cover section according to the present inventions.
Figure 25B:
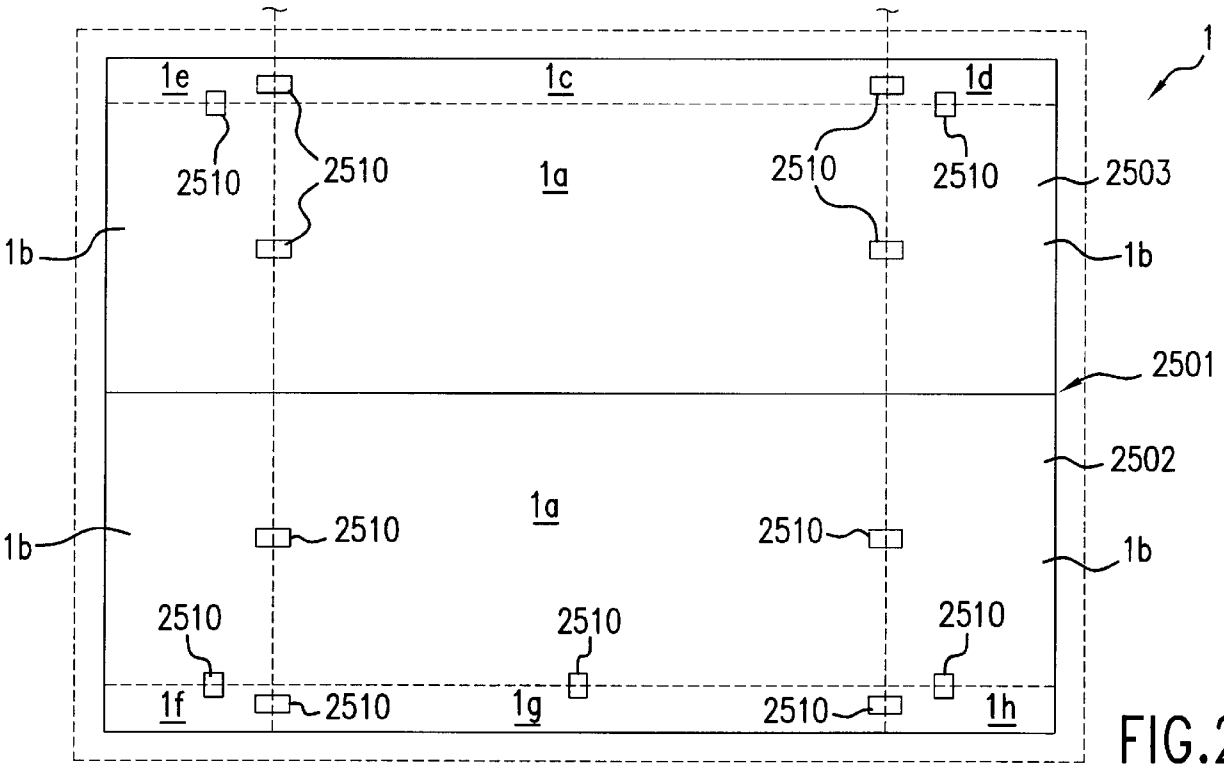

Referring now back to FIG. 6, recall that the center sections 1*a*–4*a* of the cover sections 1–4 are identical, while the end sections 1*b*–4*b* are varied to produce the required differences in height and width. This is done intentionally to reduce the cost of producing molds for the cover sections 1–4. Referring now to FIGS. 25A (end view) and 25B (top view), it can be seen that cover section 1 is formed from two sections 2502, 2503 which are joined using traditional methods at seam 2501. It should be noted that known cover sections are typically formed using four separate sections rather than 2. Because seams are costly in terms of additional material and labor, the elimination of unnecessary seams is of importance. Each of the sections comprises a center section 1*a* and two side sections 1*b*. The plugs for these three sections 1*a*, 1*b* (shown in phantom in FIG. 25) may be formed separately and attached (with latches 2510) to form a common plug. As used herein, a plug is a model, which is sized slightly larger than the intended final product if a material that shrinks during curing, such as FRP, is used. The plug is then encased by a mold material, which is later cut open to form the mold. Similarly, end sections 1*c*–1*h* (corresponding to the weather seals) may be formed using corresponding plug sections (also shown in phantom) that are attachable to sections 1*a*, 1*b*. The resulting mold is formed of only two sections, as indicated by the center dashed lines in FIG. 25A.

While the inventions have been described in detail in connection with the preferred embodiments known at the time, it should be readily understood that the inventions are not limited to such disclosed embodiments. Rather, the inventions can be modified to incorporate any number of variations, alterations, substitutions or equivalent arrangements not heretofore described, but which are commensurate with the spirit and scope of the inventions. Accordingly, the inventions are not to be seen as limited by the foregoing description, but are only limited by the scope of the appended claims.

What is claimed is:

1. A cover assembly for a barge comprising:

at least two cover sections, each of the cover sections having a width which extends over a width of a barge cargo opening, each of the cover sections comprising an assembly that allows the cover section to travel along at least one track mounted to a barge coaming, at least one of the cover sections further comprising a clamp connected to the cover section to prevent the cover section from becoming derailed, wherein each of the cover sections has a first side and a second side, the first side of one of the cover sections travels along a first track attached to a side of the barge coaming and an other cover section travels along a second track on a same side of the barge coaming as the first track.

2. The cover assembly of claim 1, wherein the cover sections are comprised of fiber reinforced plastic.

3. The cover assembly of claim 1, further comprising a third cover section and a fourth cover section, wherein at least one wheel or glide of the third cover section travels along the first track, at least one wheel or glide of the third cover section travels along a third track attached to the one of the cover sections, at least one wheel or glide of the fourth cover section travels along the second track and at least one wheel or glide.

4. The cover assembly of claim 1, wherein the assembly comprises a channel, a weight bearing first wheel, the first wheel being positioned on an axle mounted to the channel such that it travels along the top surface of the track.

5. The cover assembly of claim 4, wherein the first wheel is positioned substantially horizontally.

6. The cover assembly of claim 5, further comprising a guide wheel mounted to the channel in a position transverse to the first wheel such that the guide wheel travels along an inside vertical surface of the track to the first wheel aligned with the track.

7. The cover assembly of claim 4, wherein the assembly further comprises a second wheel mounted on the axle.

8. The cover assembly of claim 7, wherein the axle is inclined with respect to the top surface of the track.

9. The cover assembly of claim 7, wherein the axle is horizontal.

10. The cover assembly of claim 1, wherein at least one of the cover sections further comprises a cargo access opening.

11. A cover assembly for a barge comprising:

at least two cover sections, each of the cover sections having a width which extends over a width of a barge cargo opening, each of the cover sections comprising an assembly that allows the cover section to travel along at least one track mounted to a barge coaming, at least one of the cover sections further comprising a clamp connected to the cover section to prevent the cover section from becoming derailed, wherein the clamp includes a ring fixedly attached to an engaging bar, the engaging bar being pivotally mounted such that the engaging bar may pivot between a first position in which the engaging bar engages a lip and a second position in which the engaging bar does not engage the lip.

12. The cover assembly of claim 11, wherein the lip is attached to the coaming on the barge.

13. The cover assembly of claim 11, wherein the second position corresponds to a position into which a ring is urged by a force applied to the ring by a crane lifting the cover section.

14. The cover assembly of claim 11, wherein the clamp further includes a wind latch attached to an end of the engaging bar, the wind latch being of a length sufficient to engage a ring of a clamp attached to an underlying cover.

15. A cover assembly for a barge comprising:

at least two cover sections, each of the cover sections having a width which extends over a width of a barge cargo opening, each of the cover sections comprising an assembly that allows the cover section to travel along at least one track mounted to a barge coaming, at least one of the cover sections further comprising a clamp connected to the cover section to prevent the cover section from becoming derailed, wherein each of the cover sections has a first side and at least one wheel or glide travels along a first track attached to a side of the barge coaming and at least one wheel or glide of at least one of the cover sections travels along a track attached to an other cover section.

16. A cover assembly for a barge comprising:

at least two cover sections, each of the cover sections having a width which extends over a width of a barge cargo opening, each of the cover sections comprising an assembly that allows the cover section to travel along at least one track mounted to a barge coaming, at least one of the cover sections further comprising a clamp connected to the cover section to prevent the cover section from becoming derailed, wherein each of the cover sections further comprises at least one stacking shelf attached thereto, the stacking shelf including a substantially horizontal surface sized and positioned to provide support for an overlying cover section.

17. The cover assembly of claim 16, wherein each of the cover sections further comprises a stripe and first and second ends, the first and second ends being shaped to form a weather seal when mated to corresponding ends of other cover sections, the stacking stripe being positioned such that, when the cover section is stacked above or below another cover section having a second alignment stripe in alignment with the alignment stripe, damage to the weather seals is avoided.

18. A cover assembly for a barge comprising:

at least one set of cover sections;

wherein the at least one set comprises a first cover section, the first cover section being adapted to travel along a track on a barge coaming, the first cover section including a track mounted to an upper surface, and a second cover section, the second cover section having a first end and a second end, the first end being adapted to travel along the track on the barge coaming, the second end being adapted to travel along the track mounted to the upper surface of the first cover section.

19. A cover assembly for a barge comprising:

at least two cover sections, each of the cover sections having a width which extends over a width of a barge cargo opening, each of the cover sections comprising an assembly that allows the cover section to travel along at least one track mounted to a barge coaming, at least one of the cover sections further comprising a tie point attached to the cover section for dock personnel to tie onto; wherein the tie point comprises a ring and wherein the at least one cover section further comprises an anti-derailment clamp connected to the ring.

20. A method for fabricating a cover assembly comprising at least a first cover section and second cover section, the method comprising the steps of:

forming a center plug for a common center section;

forming a first end set of plugs for a first pair of end sections;

forming a first mold using the center plug and the first end set of plugs, the first mold having a single seam;

forming a second end set of plugs for a second pair of end sections, the second pair of end sections being a different height or width from the first pair of end sections;

forming a second mold using the center plug and the second end set of plugs, the second mold having a single seam;

forming a first cover section using the first mold; and forming a second cover section using the second mold.

21. The method of claim 20, further comprising the steps of:

forming a center weather seal plug;

forming a third end set of weather seal plugs;

forming a fourth end set of weather seal plugs;

connecting the center weather seal plug to the center plug;

connecting the third end set to corresponding plugs of the first end set; and connecting the fourth end set to corresponding plugs of the second end set.

* * * * *

UNITED STATES PATENT AND TRADEMARK OFFICE

CERTIFICATE OF CORRECTION

PATENT NO. : 6,352,046 B1
DATED : March 5, 2002
INVENTOR(S) : Robin L. Berg, Sr. et al.

It is certified that error appears in the above-identified patent and that said Letters Patent is hereby corrected as shown below:

Column 4,
Line 65, "is comprised of cover sections 1, 2, 3, and 4" should read
-- is comprised of cover sections 1, 2, 3, and 5 --.
Line 66, "second set is comprised of cover sections 1, 2, 3, and 5" should read
-- second set is comprised of cover sections 1, 2, 3, and 4 --.

Signed and Sealed this

Second Day of September, 2003

JAMES E. ROGAN
*Director of the United States Patent and Trademark Office*